US008314517B2

(12) United States Patent
Simard et al.

(10) Patent No.: US 8,314,517 B2
(45) Date of Patent: Nov. 20, 2012

(54) ELECTRIC TIMER FOR CONTROLLING POWER TO A LOAD

(75) Inventors: Pierre Simard, St-Bruno (CA); Benoit Meilleur, Lasalle (CA)

(73) Assignee: Honeywell International Inc., Morristown, NJ (US)

( * ) Notice: Subject to any disclaimer, the term of this patent is extended or adjusted under 35 U.S.C. 154(b) by 1148 days.

(21) Appl. No.: 12/182,069

(22) Filed: Jul. 29, 2008

(65) Prior Publication Data

US 2010/0025210 A1 Feb. 4, 2010

(51) Int. Cl.

| | |
|---|---|
| ***H01H 9/54*** | (2006.01) |
| ***H01H 33/59*** | (2006.01) |
| ***H01H 47/00*** | (2006.01) |
| ***H01H 85/46*** | (2006.01) |
| ***H01H 3/26*** | (2006.01) |
| ***H01H 3/28*** | (2006.01) |

(52) U.S. Cl. ..... 307/140

(58) Field of Classification Search ..... 307/140, 307/141; 200/33 R

See application file for complete search history.

(56) References Cited

U.S. PATENT DOCUMENTS

| | | | |
|---|---|---|---|
| D310,338 | S | 9/1990 | Cureton |
| 5,160,853 | A | 11/1992 | Simon et al. |
| 5,218,235 | A | 6/1993 | Patterson et al. |
| 5,272,427 | A | 12/1993 | Nold et al. |
| 5,572,104 | A | 11/1996 | Nold et al. |
| 5,589,741 | A | 12/1996 | Terman et al. |
| 5,736,795 | A | 4/1998 | Zuehlke et al. |
| D409,505 | S | 5/1999 | Janda et al. |
| 5,903,139 | A | 5/1999 | Kompelien |
| 6,043,611 | A | 3/2000 | Gradzki |
| 6,121,889 | A | 9/2000 | Janda et al. |
| 6,288,458 | B1 | 9/2001 | Berndt |
| D455,359 | S | 4/2002 | Stekelenburg |
| 6,490,174 | B1 | 12/2002 | Kompelien |
| D500,686 | S | 1/2005 | Stekelenburg |
| D500,687 | S | 1/2005 | Morrison et al. |
| D534,440 | S | 1/2007 | Stekelenburg |
| D575,646 | S | 8/2008 | Ni et al. |
| 2002/0186070 | A1 | 12/2002 | Wall et al. |

(Continued)

FOREIGN PATENT DOCUMENTS

| | | |
|---|---|---|
| WO | 2006022838 | 3/2006 |

OTHER PUBLICATIONS

Decora Electronic timer switches L101 Catalog, prior to Jul. 29, 2008, p. D 20, Leviton.

(Continued)

*Primary Examiner* — Carlos Amaya

(74) *Attorney, Agent, or Firm* — Seager Tufte & Wickhem LLC.

(57) ABSTRACT

A wall mountable electric timer that is capable of switching power to a load between an "on" state and an "off" state in accordance with a programmable schedule. In some cases, the electric timer may be programmed such that a user can program the electric switch by interacting with only a first button and a second button of a user interface. Alternatively, or in addition, the electric switch may include a power stealing circuit, a series of setup menus, a visual indicator to indicate the operating state of the load, and/or a randomly generated schedule.

13 Claims, 23 Drawing Sheets

U.S. PATENT DOCUMENTS

| | | | | |
|---|---|---|---|---|
| 2004/0251848 | A1 | 12/2004 | Kim | |
| 2005/0119765 | A1* | 6/2005 | Bergman et al. | 700/16 |
| 2005/0242753 | A1* | 11/2005 | Morrison et al. | 315/360 |
| 2007/0114848 | A1 | 5/2007 | Mulhouse et al. | |
| 2007/0115135 | A1 | 5/2007 | Mulhouse et al. | |
| 2007/0291010 | A1* | 12/2007 | Altonen et al. | 345/173 |
| 2007/0296280 | A1 | 12/2007 | Sorg et al. | |

OTHER PUBLICATIONS

ET616 In-Wall Electronic Timer, prior to Jul. 29, 2008, p. 96, Intermatic.
ET724 Electronic I-Wall Timer, prior to Jul. 29, 2008, p. 98, Intermatic.
Intermatic Retail switches 2008-TS89 10061, prior to Jul. 29, 2008, p. 179, Intermatic.
Suntracker 100 Series Information and Instructions, prior to Jul. 29, 2008, 6 pages, Sangamo Limited, Industrial Estate, Port Glasgow, Renfrewshire, UK, P/N 143370 issue H.
Series EI400 Series Decorator Electronic Auto-Off Timer, prior to Jul. 29, 2008, p. 59, Intermatic.
Series EI500 Decorator Digital 7-Day Time Switch, prior to Jul. 29, 2008, p. 60, Intermatic.
Series EI600 7-Day Astro Time Switch, prior to Jul. 29, 2008, p. 61, Intermatic.
Easyset Programming the Intermatic EJ500C Timer, on or prior to Feb. 24, 2006, 2 pages, No. 158EJ12685, Intermatic Incorporated, Spring Grove, IL.
ETW 190 Wall Switch Timer Features, on or prior to Feb. 22, 2008, 1 page, Aube.
TI032-3W Installation and User Guide, Nov. 30, 2006, 2 pages, 400-032-001-B, Aube.
TI033 Installation and User Guide, Nov. 30, 2006, 2 pages, 400-033-001-C, Aube.
TI034-3W Installation and User Guide, Mar. 13, 2007, 2 pages, 400-034-001-D, Aube, and TI034-3W/TI035 Addendum, Mar. 13, 2007, 2 pages, 400-034-003-B, Aube.
TI035 Installation and User Guide, Mar. 13, 2007, 2 pages, 400-035-001-C, Aube, and TI034-3W/TI035 Addendum, Mar. 13, 2007, 2 pages, 400-034-003-B, Aube.
TI040 Installation and User Guide, Jan. 15, 2007, 2 pages, 400-040-001-A, Aube.
TI044 Installation and User Guide, Jan. 9, 2007, 4 pages, 400-044-001-B, Aube.
TI052A-3W Installation and User instructions, prior to Jul. 29, 2008, 2 pages, 720-052002, Aube.
TI054A-06-3W Installation and User Instructions, prior to Jul. 29, 2008, 3 pages, 920-054-001-00-1-0, Aube.
EJ500 Installation and User Instructions, prior to Jul. 29, 2008, 2 pages, 158-00413, Intermatic Incorporated, Spring Grove, IL.
EJ500 Installation and Operating Instructions, prior to Jul. 29, 2008, 4 pages, 158EJ11853, Intermatic Incorporated, Spring Grove, IL.
LST100 Installation and Operating Instructions, prior to Jul. 29, 2008, 2 pages, Doc. No. 7000-0007, Rev. B, Swylite Corporation, Winter Park, FL.
Expanded E1600 p. 1 drawing, prior to Jul. 29, 2008, 1 page, 158EI13058.pdf.
EJ500 Installation and User Instructions, prior to Jul. 29, 2008, 4 pages, 158-00413, Intermatic Incorporated, Spring Grove, IL.
EI600 Series Installation and User Instructions, prior to Jul. 29, 2008, 4 pages, 158EI13058, Intermatic Incorporated, Spring Grove, IL.
EI20 Installation and Operating Instructions, prior to Jul. 29, 2008, 2 pages 158SS11359, Intermatic Incorporated, Spring Grove, IL.
Decora 24-Hour Programmable Timer Switch, Installation Instructions, Feb. 14, 2002, 2 pages, DI-000-6124H-20A-A0, Leviton.

* cited by examiner

ELECTRIC TIMER FOR CONTROLLING POWER TO A LOAD

FIELD

The present invention generally relates to electric timers, and more particularly, to wall mountable electric timers for switching power on and off to load.

BACKGROUND

Electric timers can be used in building or other structures to control power to a load, such as to turn power on and off to a load in accordance with a schedule or some other time parameter(s) and/or event(s). In some cases, such electric timers are programmable. There is an ongoing need for improved electric timers.

SUMMARY

The present invention generally relates to electric timers, and more particularly, to electric timers that are capable of switching power on and off to a load. In one illustrative embodiment, an electric timer is provided for switching power to a load between an "on" state and an "off" state in accordance with a programmable schedule. The illustrative electric timer may include a housing, at least one memory, a controller, and a user interface. The memory may store a programmable schedule, as well as one or more controller settings for the electric timer. The controller may be coupled to the memory, and may control the switching of power to the load between an "on" state and an "off" state in accordance with the programmable schedule. The user interface may be situated on the front of the housing and may be coupled to the controller. The user interface may include a display, a first button, and a second button. In some embodiments, the controller may be programmable such that a user can program the schedule, and in some cases one or more controller settings, by physically interacting with only the first button and the second button. In some embodiments, the user interface may also include a third button or more buttons, as desired. In some cases, the controller may be programmed to randomly generate a schedule, when desired.

The display may be a relatively large display. For example, the front of the housing may include a front surface area, and the display may be configured to occupy at least 25% of the front surface area, at least 35% of the front surface area, at least 45% of the front surface area, at least 55% of the front surface area, at least 65% of the front surface area, at least 75% of the front surface area or more. In some cases, the user interface may also include an indicator that indicates if the controller is in the "on" state or in the "off" state. This may provide the user with an easy visual way to identify the current state of the controller. In some cases, the indicator may be a Light Emitting Diode (LED), a laser and/or any other suitable light source. Alternatively, or in addition, the indicator may be icon or other visually perceptible indicator that is displayed on the display.

In some embodiments, the controller may be programmed to sequentially display a series of menus on the display when a first button is repeatedly depressed. The series of menus may include, for example, a mode menu for selecting an operating mode from two or more operating modes of the wall mountable electric timer, a time menu for setting a current time for the wall mountable electric timer, a configuration menu for setting up one or more configuration parameters of the wall mountable electric timer, and/or a program menu for setting up one or parameters related to the programmable schedule. These menus are only illustrative. The first, second and sometimes a third button may be used to traverse the series of menus, make selections, and change schedule and/or other controller parameters and/or settings.

In some cases, the programmable schedule is capable of referencing a sunset time parameter and/or a sunrise time parameter. The sunset parameter and/or a sunrise parameter may be dependent upon one or more geographic region parameters that are entered by the user, such as a latitude and/or longitudinal parameter. When so provided, the controller may have an operating mode and a setup mode, wherein in the operating mode, depressing a first button may cause the controller to switch power to the load between the "on" state and the "off" state, and depressing a second button may cause the controller to display the sunset time parameter and/or sunrise time parameter on the display.

In some embodiments, the electric timer may have a first terminal and a second terminal, where a voltage is provided between the first terminal and the second terminal at least some of the time. The electric timer may include a power stealing circuit that is coupled to the first terminal and the second terminal. The power stealing circuit may steal power from the first terminal and the second terminal during at least part of the time a voltage is applied between the first terminal the second terminal, and use at least some of the stolen current to power the controller. In some cases, a charge storage device, such as a capacitor or rechargeable battery, may be coupled to the power stealing circuit to store charge, which can be used to power the controller when a voltage is not present between the first terminal the second terminal.

This summary is provided to facilitate an understanding of some of the innovative features unique to the present invention and is not intended to be a full description. A full appreciation of the invention can be gained by taking the entire specification, claims, drawings, and abstract as a whole.

BRIEF DESCRIPTION

The invention may be more completely understood in consideration of the following detailed description of various illustrative embodiments of the invention in connection with the accompanying drawings, in which.

DETAILED DESCRIPTION

Figure 1:
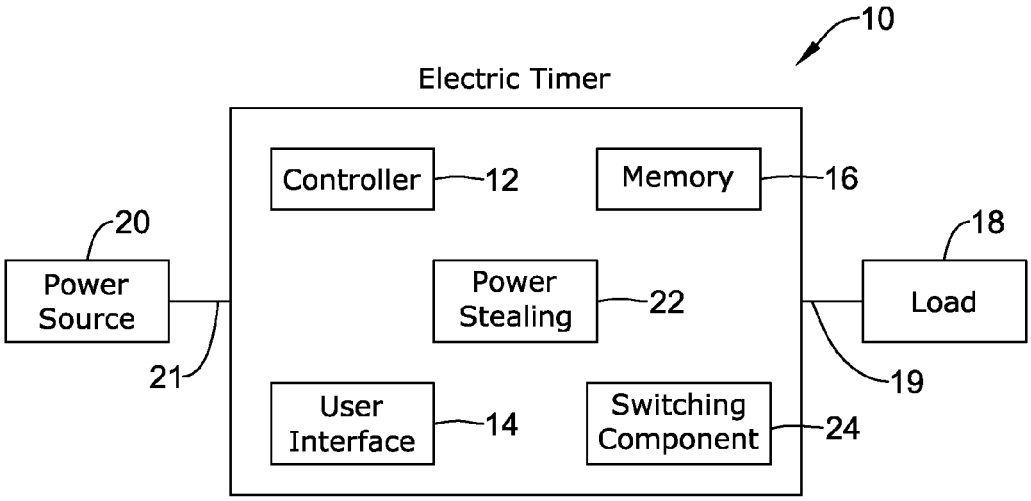
FIG. 1 is a block diagram of an illustrative electric timer for use in a building or other structure.

The following description should be read with reference to the drawings wherein like reference numerals indicate like elements throughout the several views. The detailed description and drawings show several embodiments which are meant to be illustrative of the claimed invention.

FIG. 1 is a block diagram of an illustrative electric timer 10 for use in a building or other structure. In the illustrative embodiment, the electric timer 10 may include an input port 21 connected to a power source 20 and an output port 19 connected to a load 18. The electric timer 10 may be configured to selectively provide power from the power source 20 to the load 18. In some cases, the electric timer 10 may be configured to have an "on" state, where power is supplied from the power source 20 to the load 18, and an "off" state, where power is prevented from being supplied to the load 18. In some cases, the electric timer 10 may switch between the "on" state and the "off" state in accordance with a programmable schedule.

In the illustrative embodiment, the electric timer may include a controller 12, a user interface 14, a memory 16, and a switching component 24. The switching component 24 may switch power on and off to the load 18 according to control signals provided by the controller 12. In the illustrative embodiment, the switching component 24 may include an "on" state and an "off" state. The "on" state may pass current from the power source 20 to the load 18. The "off" state may prevent current from passing from the power source 20 to the load 18. In some embodiments, the switching component 24 may be or include a relay, a transistor, a Triac, and/or any other suitable switch device, as desired.

In the illustrative embodiment, the controller 12 may be configured to control the switch state of the switching component 24 of the electric timer 10. In some embodiments, the control of the switching component 24 may be performed in accordance with a programmable schedule, a random schedule, and/or a manual input from a user.

Controller 12 may also be configured to control and/or set one or more operating parameters of the electric timer 10, such as, for example, one or more programmable switching schedules, time, date, backlight configuration, daylight savings time, location (i.e. latitude, longitude), a location correction factor, and/or other operating parameters, as desired. In some cases, the one or more switching schedules may be based, at least in part, on sunset and/or sunrise time parameters, as will be discussed in further detail below. In some instances, controller 12 may include a processor and an internal memory, if desired. The processor may be a microcontroller or a microprocessor, but this is not required.

In the illustrative embodiment, electric timer 10 may include at least one memory 16 connected to, or integral with, the controller 12 for storing information, such as, for example, the aforementioned one or more programmable switching schedules, time and date, backlight configuration, daylight savings time, location, a location correction factor, and/or other information, as desired. Memory 16 may also be configured to store any other controller 12 settings or parameters, as desired. In the illustrative embodiment, controller 12 may store information within memory 16 and may subsequently retrieve the stored information. Memory 16 may include any suitable type of memory, such as, for example, random-access memory (RAM), read-only member (ROM), electrically erasable programmable read-only memory (EEPROM), flash memory, or any other suitable memory, as desired.

User interface 14 may be any suitable interface that is configured to display and/or solicit information as well as permit a user to enter data and/or other settings or parameters, as desired. In some cases, user interface 14 may allow a user or technician to program and/or modify one or more operational parameters or functions of electric timer 10, such as, for example, the programmable switching schedules, time, date, backlight configuration, daylight savings time, location, a location correction factor, and/or other information, as desired.

In some embodiments, the user interface 14 may include a display and one or more buttons. In some cases, the display may be a fixed segment display. However, it is contemplated that the display may be any suitable display including, for example, a touch screen display, a liquid crystal display (LCD) panel, a dot matrix display, or any other suitable display, as desired. In one illustrative embodiment, the one or more button may include a first button, a second button, and a third button. The user interface 14 may be configured such that a user can program the programmable schedule and the one or more controller 12 settings by interacting with the user interface. In some cases, this may be accomplished by only interacting with the first button and the second button. In other cases, the controller 12 may be programmed by interacting with the first button, the second button, and the third button, if desired. More buttons may be provided, if desired. Also, it is contemplated that the buttons may be separate and spaced from the display and/or touch regions defined as "buttons" on a touch screen display. In some cases, the buttons may be soft buttons, which may include a button situated adjacent the display with a label or other function indicator displayed on the display adjacent the button.

In some embodiments, the controller 12 may be connected to the user interface 14 to receive and/or display one or more operational parameters to and/or from a user. In some cases, the controller 12 may be configured to program the operational parameters, such as, for example, the one or more programmable schedules, time, date, backlight configuration, daylight savings time, location, a location correction factor, and/or other parameters or settings as desired, by accepting user inputs from the first button, the second button, and/or the third button.

In the illustrative embodiment, the power source 20 may be a power supply of a building or other structure. For example, the power source 20 may be a line voltage supply of a building. In some cases, the line voltage may be 120 volts 60 Hz AC power. In this case, the power supply 20 may include two or more wires, one wire being a line voltage or "hot" and a second wire being common or neutral. However, it is contemplated that in some cases, the power supply may include one wire being a line voltage or "hot" without a second wire, if desired. Alternatively, the power source 20 may supply another voltage, such as a 24 volts 60 Hz AC power, DC power, or any other suitable voltage and/or current. In the illustrative embodiment, the electric timer 10 may include an input port 21 connected to the power source 20 and an output port 19 connected to the load 18. In some cases, the input port 21 may include a first terminal and a second terminal. The first terminal may be connected to the line voltage and the second terminal may be connected to common. However, this is merely illustrative and it is contemplated that any suitable power source 20 and/or input and output terminals of the electric timer 10 may be used, as desired.

In some embodiments, electric timer 10 may be programmed to switch power on and off to the load 18. Example loads may include, but are not limited to, lighting devices, motors, electrical appliances, and/or any other suitable load, as desired. Example lighting devices may include fluorescent lights, compact fluorescent lights (CFL), electronic ballasts, sodium lamps, tungsten lights, incandescent lights, halogen lights, as well as any other suitable lighting devices. Example motors may include pumps, actuators, actuatable valves and/or dampers, and fans. More generally, it is contemplated that the load 18 may be any suitable electrical device where it may be desirable to switch power on and off.

In some embodiments, the electric timer 10 may include a power stealing block 22. Power stealing block 22 may be configured to "steal" power from the power source 20 and/or load 18 in order to power at least part of the electric timer 10. In some cases, the power stealing block 22 may be connected to the input port 21 and/or the output port 19. The power stealing block 22 may "steal" power from the input port 21 and/or the output port 19 during at least part of the time a voltage is applied to and/or between the input port 21 and/or the output port 19. In some cases, the power stealing block 22 may include a charge storing device, such as a capacitor or rechargeable battery, for storing at least some of the power stolen by the power stealing block 22. In some cases, if power is lost, the electric timer 10 may be configured to reduce power consumption. For example, the electric timer 10 may cause the display of the user interface to be blank. In some cases, the electric timer 10 may shut off except for an internal clock, which may be implemented by controller 12 or elsewhere.

In some embodiments, the electric timer 10 may include an operating mode and a setup mode. When in the operating mode, the electric timer 10 may switch power to the load between the "on" state and the "off" state, sometimes in accordance with a programmable schedule, a random schedule, and/or a manual input from a user. In some cases, the manual input from the user may be pressing one of the buttons of the user interface 14.

In some embodiments, the electric timer 10 may be configured to display one or more operating parameters on the display of the user interface 14. For example, the controller 12 may be configured to display a first operating parameter when a first button of the user interface 14 is pressed and a second operating parameter when a second button is pressed. In addition, and in some cases, the electric timer 10 may be configured to display the status of the load 18 when in the operating mode.

An illustrative setup mode may allow a user to modify one or more parameters of the electric timer 10. In some cases, the setup mode may be entered by depressing a first button. In some cases, setup mode may be entered by depressing a button for an extended period of time. In some cases, the extended period of time may be one second, two seconds, three seconds, four seconds, five seconds, ten seconds, or any other period of time, as desired. When in setup mode, depressing the first, second, or third buttons may toggle through a plurality of screens to adjust parameters of the electric timer 10.

Figure 2:
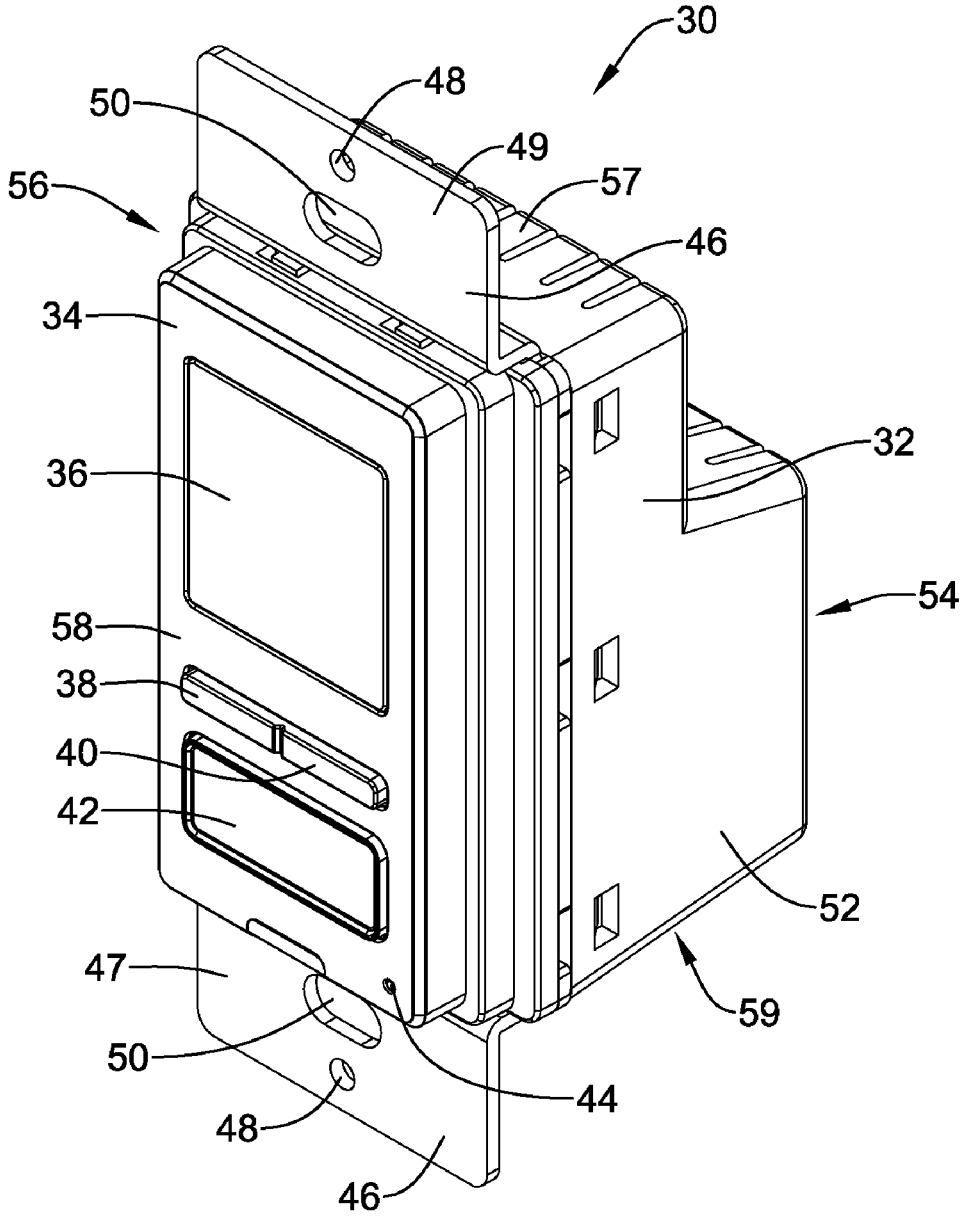
FIG. 2 is a perspective view of an illustrative electric timer.

FIG. 2 is a perspective view of an illustrative electric timer 30. In some instances, electric timer 30 may represent a manifestation of electric timer 10 of FIG. 1, but this is not required. In the illustrative embodiment of FIG. 3, the electric timer 30 may include a housing having a face plate 34 and a body 32. The illustrative housing may include a front side 58, a back side 54, and side walls 52, 56, 57, and 59 extending between the front side 58 and the back side 54. In the orientation shown, side wall 54 may be a right side wall, side wall 56 may be a left side wall, side wall 57 may be a top side wall, and side wall 59 may be a bottom side wall. It is contemplated that the housing may be formed from any suitable material, such as a polymeric, metallic, and/or any other suitable material, as desired.

In some cases, such as, for example, when utilized in a building or other structure, the electric timer 30 may be configured to be mounted at least partially within a wall of the building or structure. In some installations, the electric timer 30 may be mounted in a junction box (not shown), with the back side 54 situated within and/or towards the junction box and the front side 58 facing away from the junction box. However, it is contemplated that any suitable mounting configuration and/or orientation may be used, as desired.

The illustrative electric timer 30 may include a mounting plate 46. The mounting plate 46 may assist in mounting the electric timer 30 to a wall or junction box of a building or structure. As illustrated, mounting plate 46 may include a top flange portion 49 extending from the top side 57 of the housing and a bottom flange portion 47 extending from the bottom side 59 of the housing. Bottom flange portions 47 and top flange portion 49 may each include openings, such as opening 48 and opening 50. Opening 50 may be configured to receive a screw to help secure the mounting plate 46 to a wall or a junction box in a wall of a building or structure. Opening 48 may be configured to receive a screw to mount a cover (not shown), such as a decorative wall plates. Some suitable decorative wall plates are commercially available from Leviton Manufacturing Company, located in Little Neck, N.Y., and which are sold under the trademark Decora™. In some cases, the cover may have an opening that extends around and exposes the face plate 34, but covers the remaining portion of the electric timer 30 when mounted. In this case, opening 48 may be a threaded opening to assist in holding the screw therein.

The illustrative electric timer 30 includes a display 36, a first button 38, a second button 40, and a third button 42, and an indicator 44 defining a user interface of the electric timer 30. As shown, the user interface is situated on the front side 58 of the housing, with the display 36, button 38, button 40, and button 42 all disposed within a portion of the face plate 34 of the housing. In some cases, the display 36 of the user interface may be either inset or recessed within the face plate 34 of the housing as shown. The buttons 38, 40, and/or 42 may extend or protrude out from the face plate 34 as shown. It is contemplated, however, that the display and buttons 38, 40, and 42 may be flush with the face plate 34 or have any other suitable configuration, if desired.

The front side 58 of the housing may have a surface area. As illustrated, the display 36 of the user interface may occupy an amount or percent of the surface area of the front side 58 of the housing. In some cases, the display 36 may occupy at least 25 percent of the surface area of the front side 58 of the electric timer 30. In other cases, the display 36 may occupy at least 35% of the surface area of the front side 58, at least 45% of the surface area of the front side 58, at least 55% of the surface area of the front side 58, at least 65% of the surface area of the front side 58, at least 75% of the surface area of the front side 58 or more.

In the illustrative embodiment, display 36 may be fixed-segment display, as illustrated. However, it is contemplated that display 36 may be a touch screen display, a liquid crystal display (LCD) panel, a dot matrix display, a cathode ray tube (CRT), or any other suitable display, as desired. A dot matrix display is typically a LCD display that permits images such as letters, numbers, graphics, and the like to be displayed anywhere on the LCD, rather than being confined to predetermined fixed segments or locations, such as is the case with a fixed segment LCD.

The indicator 44 may indicate the status ("on" or "off") of the load. As illustrated, the indicator 44 may be a light, such as, for example, a light emitting diode (LED), Laser or any other suitable light source, provided in the bottom corner of the front side 58 of the face plate 34. In some cases, the indicator 44 may include a colored light, such as, for example, blue, red, green, yellow, or any other color, as desired. In some embodiments, when the load 18 is on, the light of indicator 44 may be on and, when the load 18 is off, the light of indicator 44 may be off. In some cases, the indicator 44 may be configured to flash according to the status of the load. For example, the indicator 44 may flash at an interval if the load 18 is on. In other examples, it is contemplated that the flashing of the indicator 44 may indicate the status of the load 18. If the indicator is flashing, the load may be on and if the indicator 44 is on but not flashing, the load may be off, or visa versa. These are only examples, and when present, it is contemplated that any suitable indicator 44 positioned at any suitable location may be used to indicate the status of the load 18, as desired.

In some embodiments, pressing button 38 may display an operating parameter of the electric timer 30 on display 36. Also, in some cases, pressing button 40 may display another operation parameter of the electric timer 30 on display 36. In some cases, pressing one of button 38 or button 40 may display the sunset parameter and pressing the other of button 38 or button 40 may display the sunrise parameter. In some embodiments, the factory programming of the electric timer 30 may be restored by a user by pressing a combination of buttons. In one example, the electric timer 30 may be configured to reset the factory settings by pressing button 38 and button 42 for a period of time, such as, three seconds, four seconds, five seconds, ten seconds, or any other period of time, as desired.

The electric timer 30 may be configured to provide substantial display and/or programming functionality. FIGS. 3 through 7 provide examples of screens that may be displayed by electric timer 30 of FIG. 2 during operation. In some cases, the screens may include a home screen that can be displayed by electric timer 30 as a default screen, when no other data entry is underway, and/or when selected by the user. A home screen may, if desired, display one or more parameters relating to operational conditions such as mode of operation, time, day, program status, load status, and/or any other suitable parameter or setting, as desired.

In some cases, the user may be provided access to one or more sub-menus or other menus of the electric timer 30 by depressing one or more of buttons 38, 40, and 42. For example, if one or more of buttons 38, 40, and 42 is depressed for an extended period of time, the user may enter a setup menu to setup and/or modify one or more parameters and/or settings of the electric timer 30, such as the time, date, backlight, daylight savings time setting, location (i.e. latitude, longitude, and/or correction factor), programmable schedules, modes of operations, and/or any other suitable parameter or setting, as desired. In some cases, if one or more buttons 38, 40, and 42 is depressed for the extended period of time while in the setup or other sub-menu, the electric switch 30 may return to the home screen and exit the setup mode.

Figure 3:
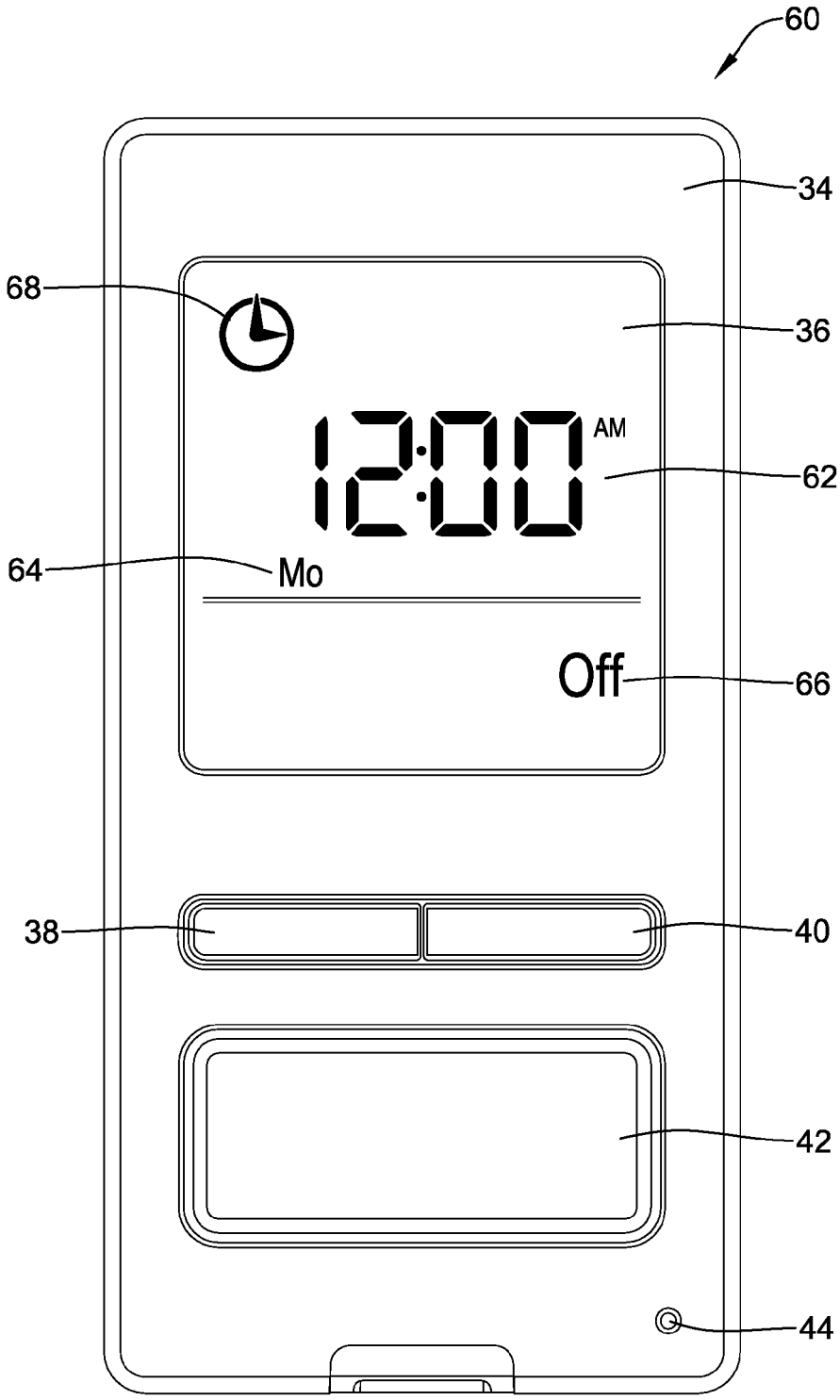
FIGS. 3-7E are pictorial views showing some illustrative screens that can be displayed on the display of the electric timer of FIG. 2.

FIG. 3 shows a pictorial view of an illustrative home screen 60 that may be displayed on display 36. In the illustrative embodiment, home screen 60 may be displayed when the electric timer 30 is in the operating mode. In some cases, home screen 60 may be configured to display information on the display 36 about the operational status of the electric timer 30 and/or load 18. For example, the information may include the current mode of operation of the electric timer 30, the current time 62, the current day of the week 64, the current program, the status of the load 18, and/or other operational information, as desired. In the illustrative embodiment, the home screen 60 displays icon 68 indicating that the mode of operation is automatic, the current time 62 is "12:00" A.M., the current day of the week 64 is Monday, and the status of the load is off, as indicated by "Off" icon 66.

In the illustrative embodiment, a user may press various buttons 38, 40, and 42 of the user interface to access and/or modify various operational settings of the electric timer 30. For example, briefly pressing button 38 may display the sunset time or sunrise time, and briefly pressing button 40 may display the other of the sunset time or sunrise time during normal operation of the electric timer 30. Pressing button 40 for an extended period of time may change the operational mode of the electric timer 30 to, for example, manual or random mode. Briefly pressing button 42 may temporarily override the current programmed schedule of the electric timer 30, and manually switch the load between on or off. Pressing button 42 for an extended period of time may access a setup mode of the electric timer 30. The setup mode may allow a user to modify and/or set one or more parameters or settings of the electric timer 30. For example, the extended period of time may be one seconds, two seconds, three seconds, four seconds, five seconds, ten seconds, or any amount of time as desired. Further, it is contemplated that the extended period of time for pressing button 40 and button 42 may be the same time or a different time, as desired.

FIGS. 4-7 show pictorial views of illustrative screens that may be displayed on display 36 when the electric timer 30 is in setup mode. The setup mode may allow a user to modify one or more parameters or settings of the electric timer 30. In some cases, a visual confirmation may be provided to the user when a setting is accepted by the electric timer 30. In some cases, the visual confirmation may be a blink or series of blinks of the corresponding icon on the display or other portion of the display, as desired.

Figure 4A:
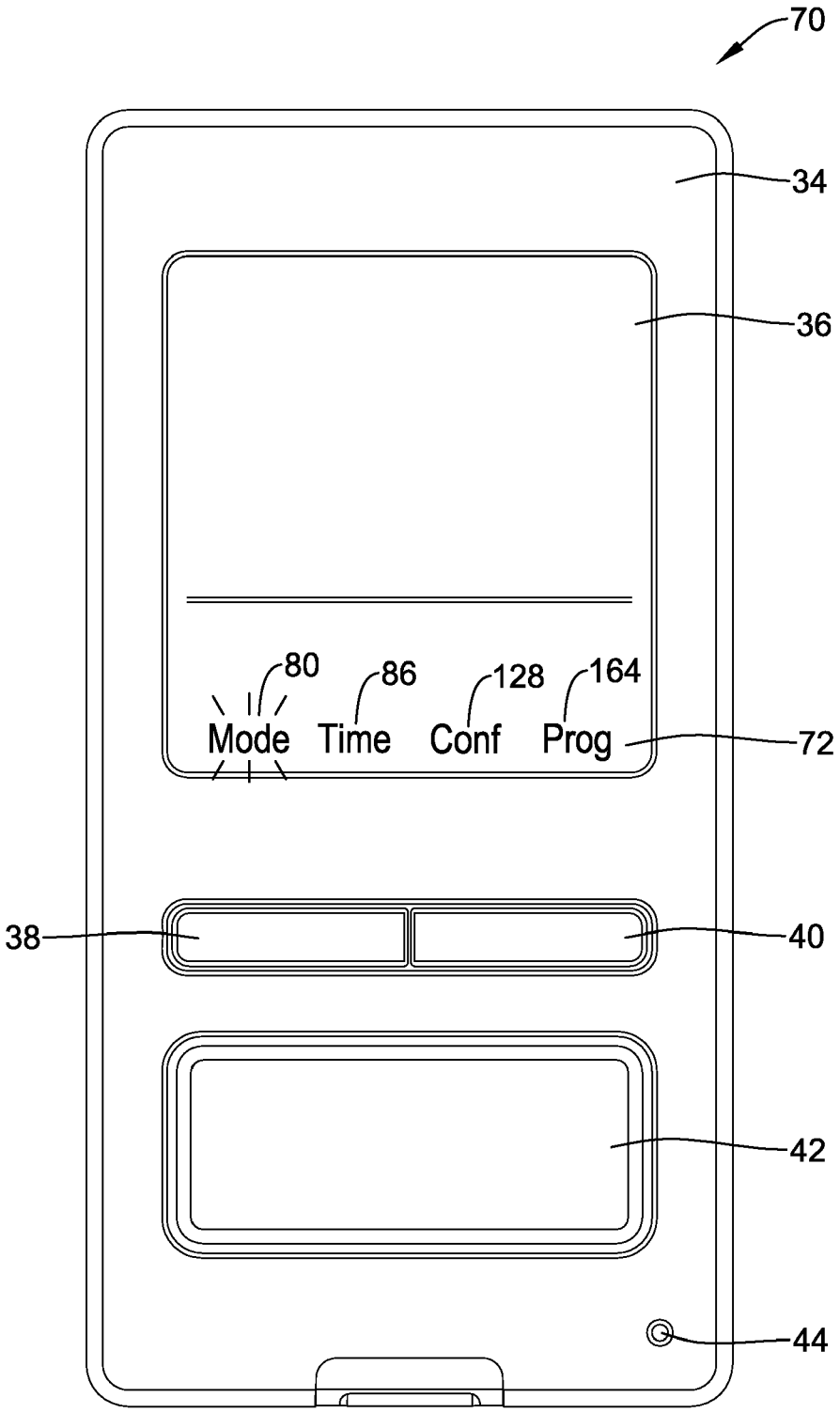

FIG. 4A shows a pictorial view of a screen 70 that may be displayed on the display 36 of the electric timer 30 after the setup mode is entered, but this is not required. In the illustrative embodiment, screen 70 may be a setup menu screen, and may allow a user to access one or more sub-menus. For example, the one or more sub-menus may include a mode menu, a time menu, a configuration menu, and a program menu. These are only illustrative, and it is contemplated that any suitable sub-menus may be displayed, when desired. As shown, screen 70 includes a list of icons 72 that may be selected to access a corresponding sub-menu. For example, the list of icons 72 may include a "Mode" icon 80 for accessing a mode menu, a "Time" icon 86 for accessing a time menu, a "Conf" icon 128 for accessing a configuration menu, and a "Prog" icon 164 for accessing a program menu.

A user may toggle or scroll through the list of icons 72 by pressing button 38 and/or button 40. In one example, button 40 may be configured to move to the next icon and button 38 may be configured to move to the previous icon. When a desired icon 80, 86, 128, or 164 is selected, the user may press button 42 to accept the selection and move to the corresponding sub-menu. The selected icon 80, 86, 128, or 164 may be indicated as being selected by highlighting, flashing, color, or some other indication, as desired. As illustrated, "Mode" icon 80 has been selected as indicated by the lines above and below the "Mode" 80 text, which in the Figure shown, indicates that the Mode text is flashing. Since the "Mode" icon 80 has been selected, pressing button 42 will accept this selection and display the mode menu screen 74 of FIG. 4B.

Figure 4B:
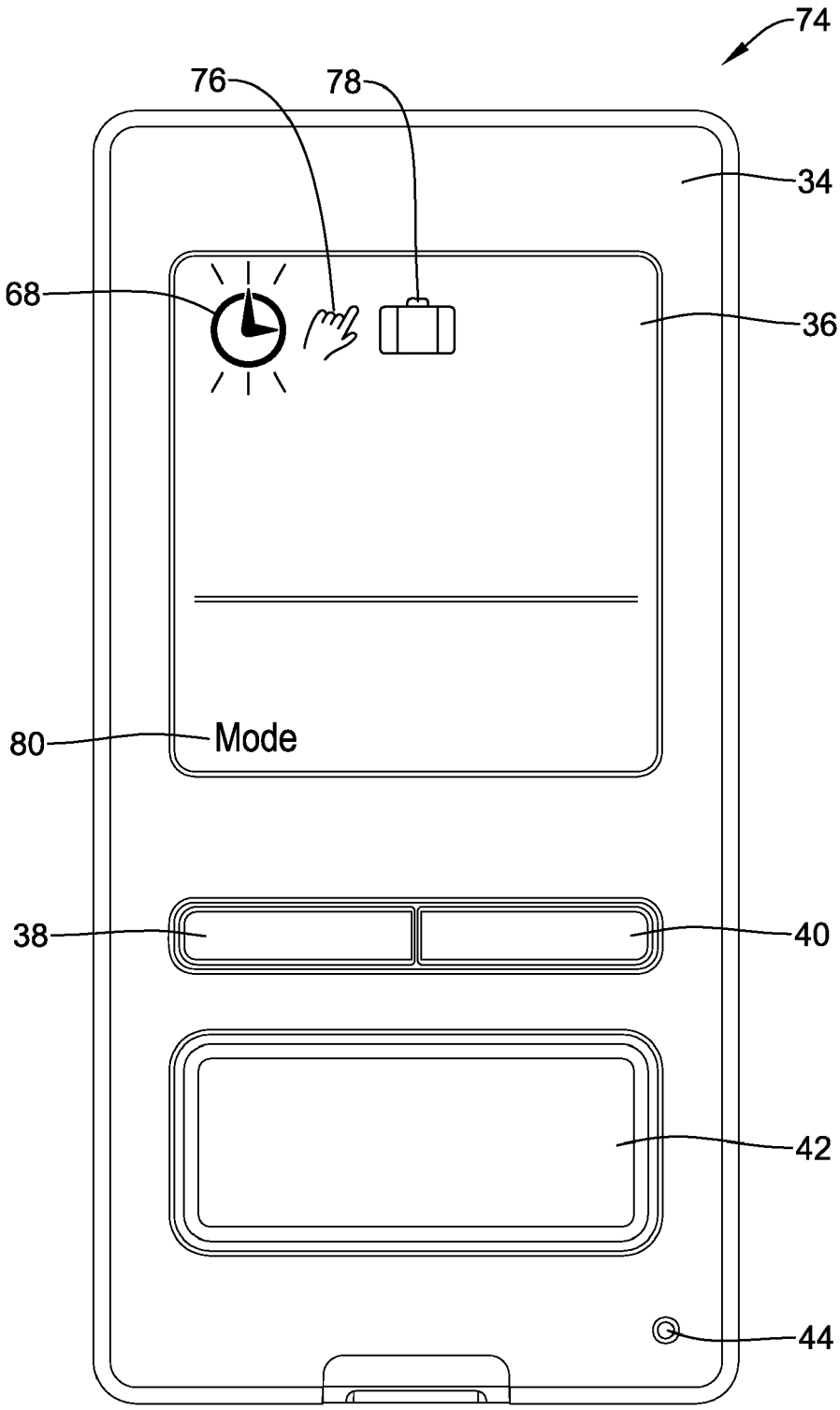

In FIG. 4B, the mode menu screen 74 may allow a user to select between an automatic mode, a manual mode, and a random mode. However, it is contemplated that other suitable modes of the electric timer 30 may also be provided, as desired. As illustrated, icon 68 corresponds to the automatic mode, icon 76 corresponds to manual mode, and icon 78 corresponds to random mode. The "Mode" icon 80 may be displayed on display 36 indicating that screen 74 is part of the mode menu screen 74.

Manual mode may operate the electric timer 30 as a manual switch. For example, the load may be turned on and off by manually pressing a button of the user interface, such as, for example, button 42. Automatic mode may operate the electric timer 30 in accordance with a programmable schedule. Random mode may operation the electric timer 30 in accordance with a randomly generated schedule. The randomly generated schedule may turn the load on and off at random, or non-specified, times. In some cases, the electric timer 30 may randomly generate turn "on" times and turn "off" times for the random schedule. In some embodiments, some constraints may be placed on the randomly generated "on" and "off" times, such as only generating turn "on" times and turn "off" times during the periods from sunset to midnight and from 5:00 AM until sunrise. The random mode may be used to give the impression that a building is occupied during a user absence.

In some embodiments, if during operation, the electric timer 30 is operating in automatic mode or in random mode, a temporary override may be allowed. The temporary override may be initiated by, for example, pressing button 42. The temporary override may allow the user to manually switch the electric timer 30 between the "on" state and the "off" state. For example, if the electric timer 30 is in the "on" state when the temporary override is initiated, the electric timer 30 may be switched to the "off" state. Similarly, if the electric timer 30 is in the "off" state when the temporary override is initiated, the electric timer 30 may switch to the "on" state. In either case, the status of the load displayed on display 36 may begin to flash to indicate the temporary override condition. In some cases, the temporary override may continue until the user presses button 42 again or until the next "on" state or "off" state of the current schedule.

In FIG. 4B, a desired operating mode may be selected by pressing button 38 and/or button 40 to scroll across icons 68, 76, and 78. An icon 68, 76, or 78 is indicated as selected by highlighting, flashing, or other indication, as desired. When the desired icon 68, 76, or 78 is selected, the user may press button 42 to accept the setting. After the setting is accepted, the electric timer 30 may return to display screen 70 of FIG. 4A.

Figure 5A:
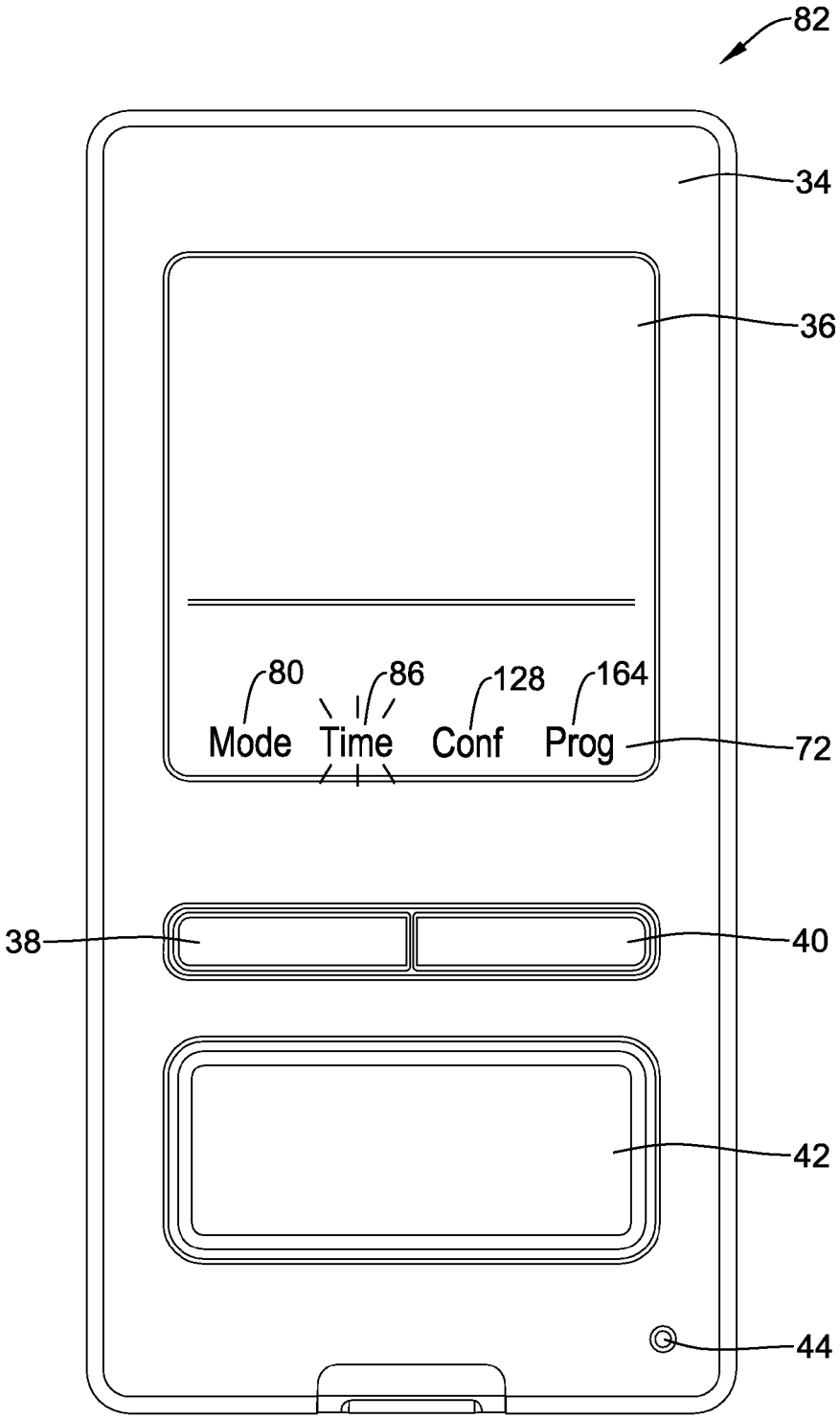

FIG. 5A shows a pictorial view of an illustrative screen 82 of the setup menu, similar to screen 70 of FIG. 4A, but with the "Time" icon 86 selected. As discussed previously, a desired icon 80, 86, 128, or 164 may be selected by pressing button 38 and/or button 40 to scroll across the list of icons 72. In the illustrative embodiment, a user may press button 42 to accept the setting and display the corresponding sub-menu of the icon. Icon 86 is selected in FIG. 5A, and when accepted by pressing button 42, a time menu may be displayed on display 36. An illustrative time menu may include each of the sub-menu screens 84, 90, 94, 98, 104, and 110 of FIGS. 5B-5G, respectively, "Time" icon 86 may be displayed on each of these sub-menus indicating that the electric timer 30 is currently executing the time menu option.

Figure 5B:
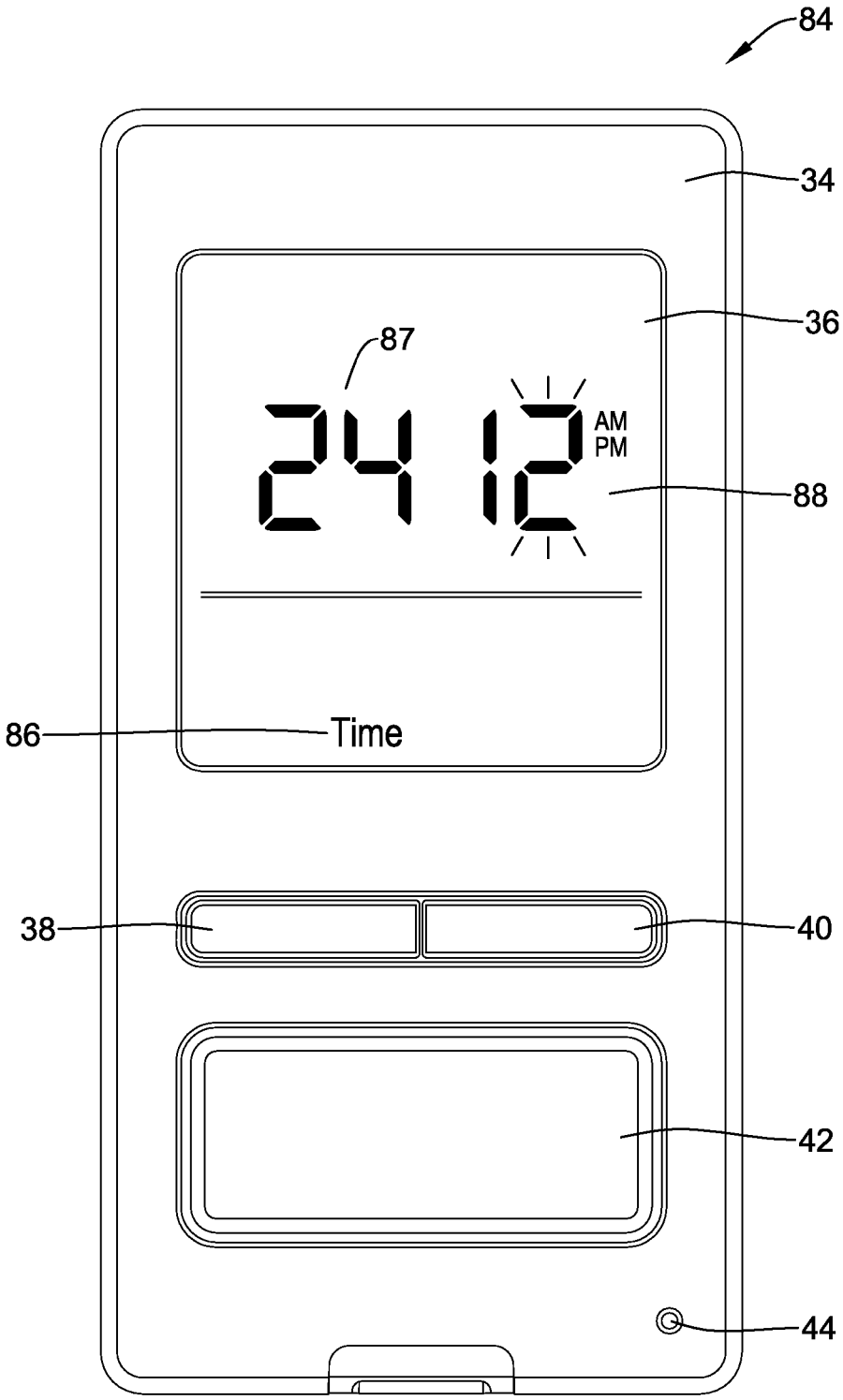
Figure 5C:
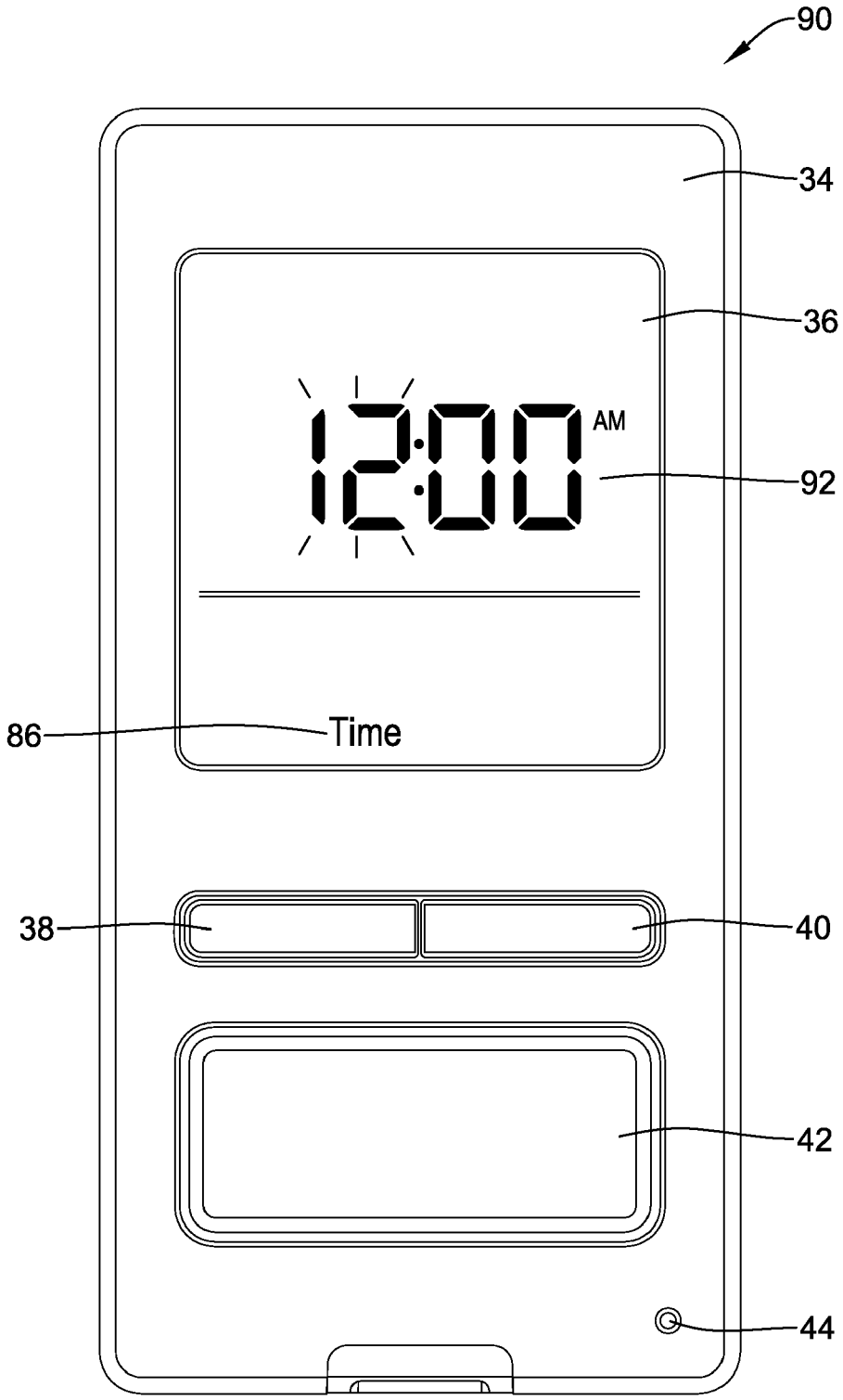
Figure 5D:
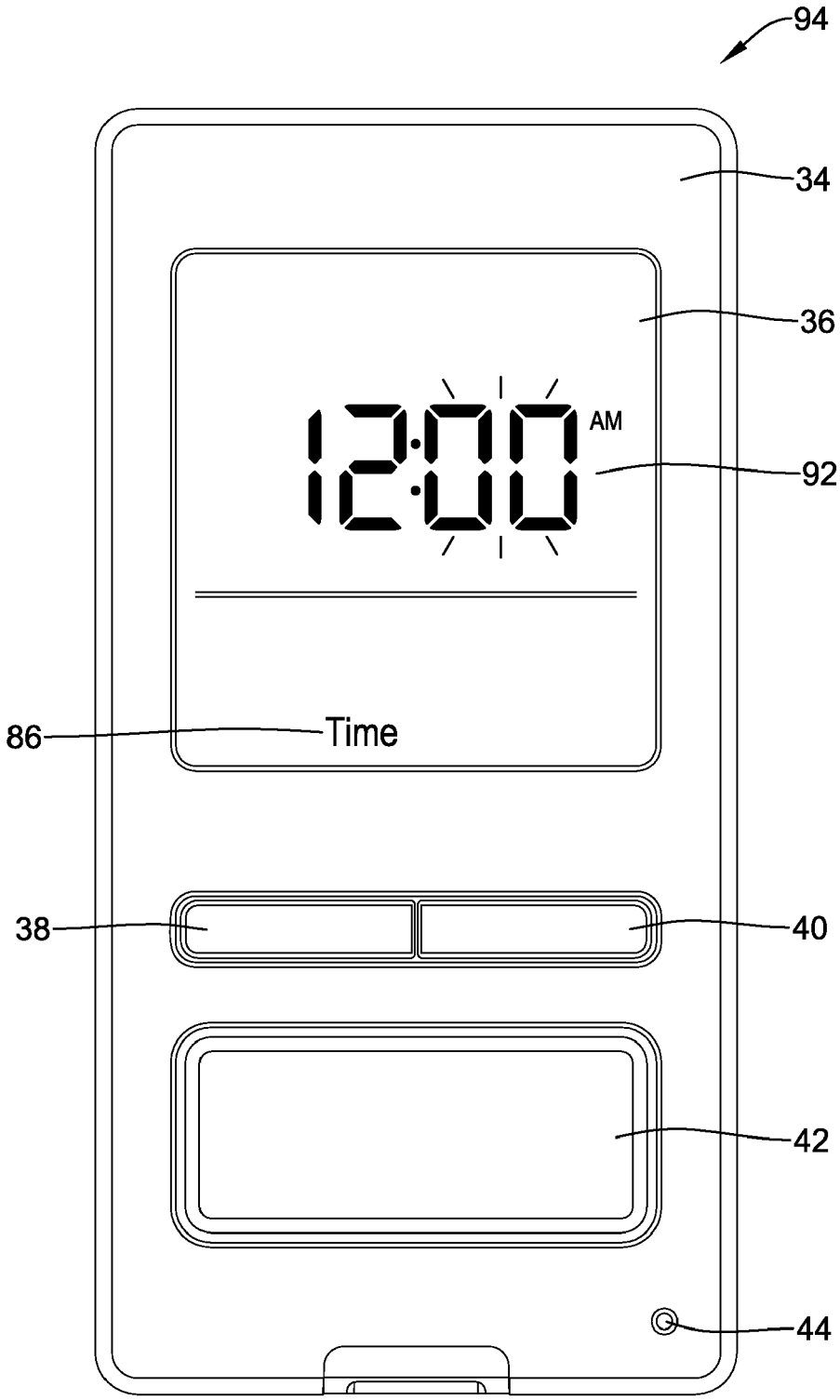

FIG. 5B-5D show pictorial views of illustrative screens 84, 90, and 94 for formatting and setting the time of the electric timer 30. More specifically, FIG. 5B shows a pictorial view of an illustrative screen 84 that may be displayed on display 34 for setting the format of the time display. Screen 84 may be configured to allow a user to set the format of the time to be displayed on display 36. As illustrated, screen 84 may display a "24" icon 87 and a "12" icon 88 on the display 36. The "24" icon 87 may correspond to a 24 hour time format, and the "12" icon 88 may correspond to a 12 hour time format. The user may be able to select the desire time format icon 87 or icon 88 by pressing button 38 and/or button 40. As illustrated, the "12" icon 88 corresponding to the 12 hour time format is indicated as selected by highlighting, blinking, or other indication, as desired. To accept the selected time format, a user may press button 42.

Once accepted, the electric timer 30 may display the illustrative screen 90 shown in FIG. 5C. As illustrated in FIG. 5C, a current time indicator 92 may be displayed on at least a portion of display 36. In the illustrative screen 90, the hour field of the time indicator 92 may be highlighted, blinking, or otherwise indicated. The user may adjust the hour field using button 38 (e.g. adjust forward in time) and/or button 40 (e.g. adjust backward in time). In some cases, the user may increase the hour field of time indicator 92 by pressing button 40, and the user may decrease the hour field of the time indicator 92 by pressing button 38. However, it is contemplated that the hour field may be set using any suitable button or combination of buttons, as desired. Once the desired hour field of the time indicator 92 is displayed, the user may press button 42 to accept the setting. Once accepted, the electric timer 30 may display the illustrative screen 94 shown in FIG. 5D.

In FIG. 5D, the minute field of the time indicator 92 may be highlighted, blinking, or otherwise indicated. The user may adjust the minute field using button 38 and/or button 40. In some cases, the user may increase the minute field of time indicator 92 by pressing button 40, and the user may decrease the minute field of the time indicator 92 by pressing button 38. However, it is contemplated that the minute field may be set using any suitable button or combination of buttons, as desired. Once the desired minute field of the time indicator 92 is displayed, the user may press button 42 to accept the setting. Once accepted, the electric timer 30 may display the illustrative screen 98 shown in FIG. 5E.

Figure 5E:
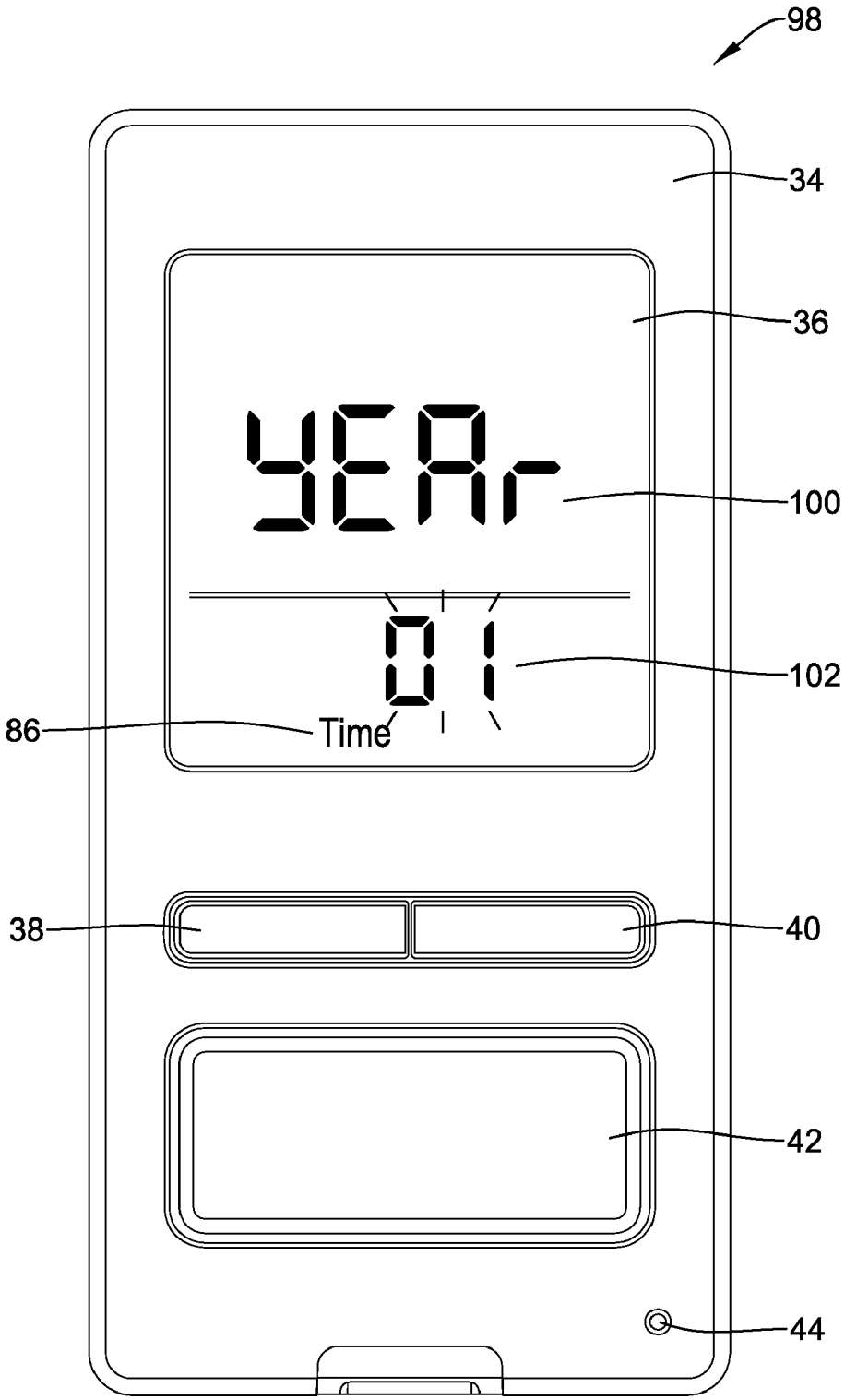
Figure 5F:
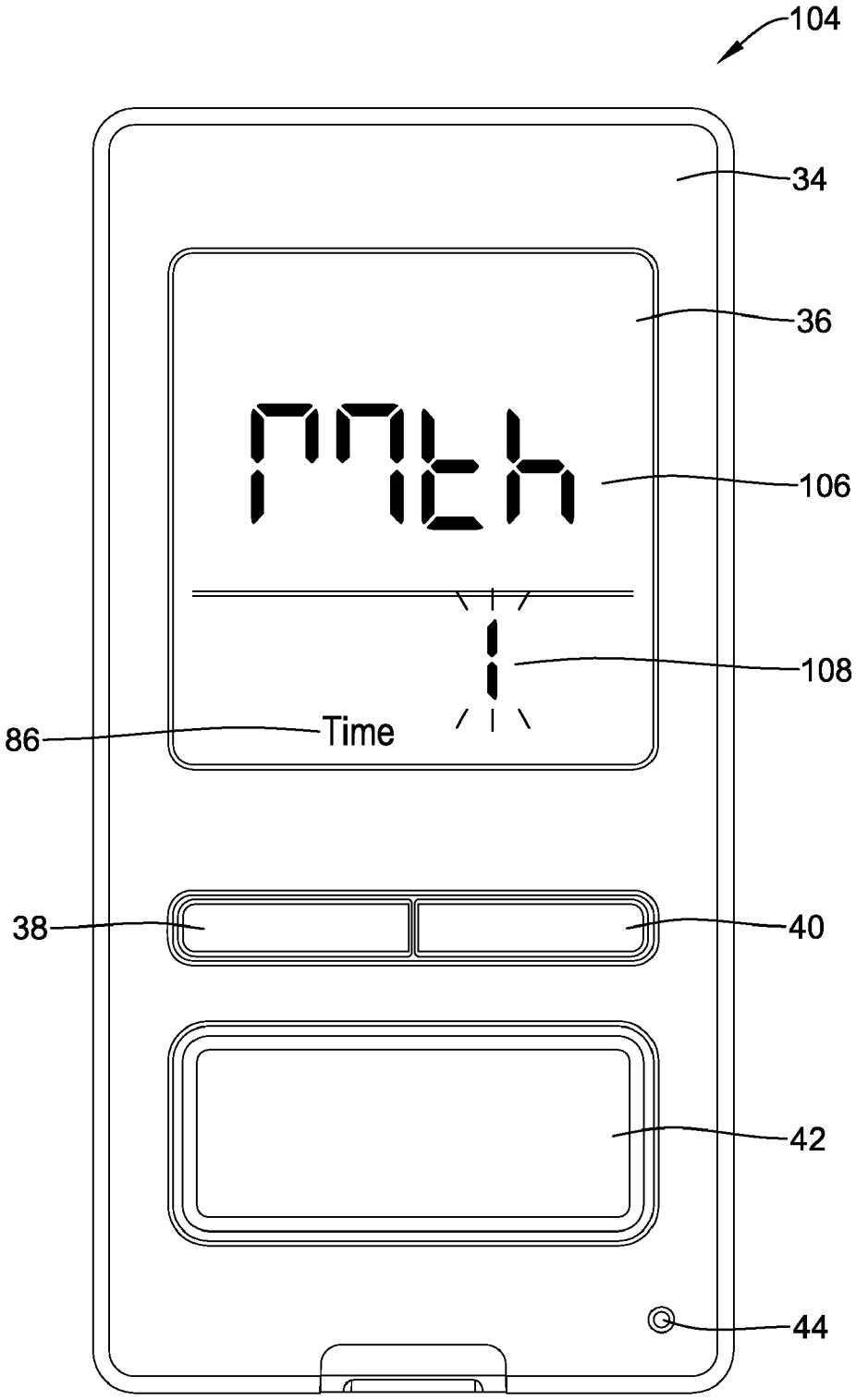
Figure 5G:
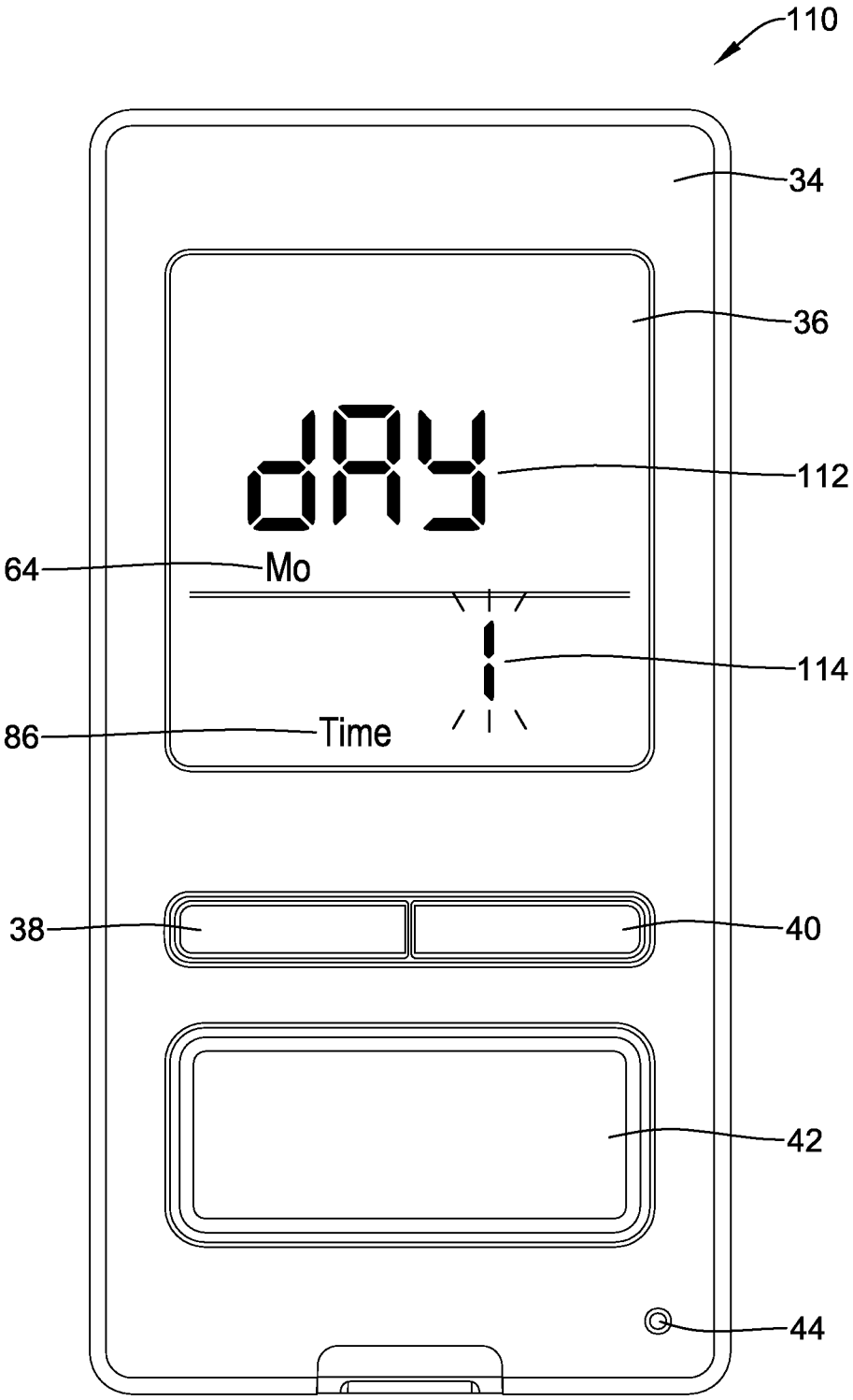

FIG. 5E-G show pictorial views of illustrative screens 98, 104, and 110 that may be used to set the current date of the electric timer 30. More specifically, FIG. 5E shows a pictorial view of an illustrative screen 98 for setting the current year. As illustrated, screen 98 may display "year" 100 on the display 36 to indicate that the current year is to be set. Screen 98 may also include an icon 102 for displaying the year. As illustrated, icon 102 displays "01" and may be highlighted, flash, or otherwise indicated. In the illustrative embodiment, the year may be displayed as a two digit year. For example, "01" of icon 102 may correspond to year 2001. However, it is contemplated that a three digit or four digit year icon may be provided as desired. To set the current year, the user may press button 38 and/or button 40 until icon 102 displays the two digit number corresponding to the current year. When the desired year is displayed in icon 102, the user may press button 42 to accept the year.

Once accepted, and in the illustrative embodiment, the electric timer 30 may display the illustrative screen 104 shown in FIG. 5F for setting the current month. As illustrated, screen 104 may display "Mth" 106 on the display 36 to indicate that the current month of the year is to be set. Screen 104 may also include an icon 108 for displaying the current month. In the illustrative embodiment, icon 108 may be set as any number from 1 to 12, each number corresponding to a month of the year. As illustrated, icon 108 displays "1" (e.g. January) and may be highlighted, flash, or otherwise indicated. To set the current month, the user may press button 38 and/or button 40 until icon 108 displays the number corresponding to the current month of the year. If the user presses button 38 and/or button 40 to increase the number of icon 108 corresponding to the month when "12" is displayed, then icon 108 may roll over and display "1" again. Similarly, if the user presses button 38 and/or button 40 to decrease the number of icon 108 corresponding to the month when "1" is displayed, then icon 108 may roll over and display "12". When the desired month is displayed in icon 108, the user may press button 42 to accept the setting.

Once accepted, and in the illustrative embodiment, the electric timer 30 may display the illustrative screen 110 shown in FIG. 5G for setting the current day of the month. As illustrated, screen 110 may display "day" 112 indicating that the current day of the month is to be set. Screen 110 may also include an icon 114 for displaying the current day of the month. In the illustrative embodiment, icon 114 may be set as any number from 1 to 31, depending on the month that was set in screen 104 of FIG. 5F. As illustrated, icon 114 displays "1" and may be highlighted, flash, or otherwise indicated. To set the current day, the user may press button 38 and/or button 40 until icon 1114 displays the current day of the month. In some cases, if the user presses button 38 and/or button 40 to increase the day past the last day of the month, then icon 114 may roll over and display "1" for the first day of the month. Similarly, if the user presses button 38 and/or button 40 to decrease the day of the month when icon 114 shows the first day of the month, icon 114 may display the last day of the month. When the desired day is displayed in icon 114, the user may press button 42 to accept the setting.

In some embodiments, as illustrated on screen 110, the electric timer 30 may include icon 64 indicating a day of the week icon 64 corresponding to the selected date of the month. For illustrative purposes, icon 64 may appear as "Mo" indicating that the day of the week (e.g. Monday) corresponding to the day of the month shown by icon 114. In some cases, the controller of the electric timer 30 may determine the day of the week to be displayed according to the date input by the user. In some cases, the controller may include an algorithm, a look-up table, or other mechanism for determining the day of the week, as desired. In some cases, the day of the week icon 64 may be displayed before the date is set (i.e. before button 42 is pressed) and may change when the user changes the selected day of the month.

Figure 6A:
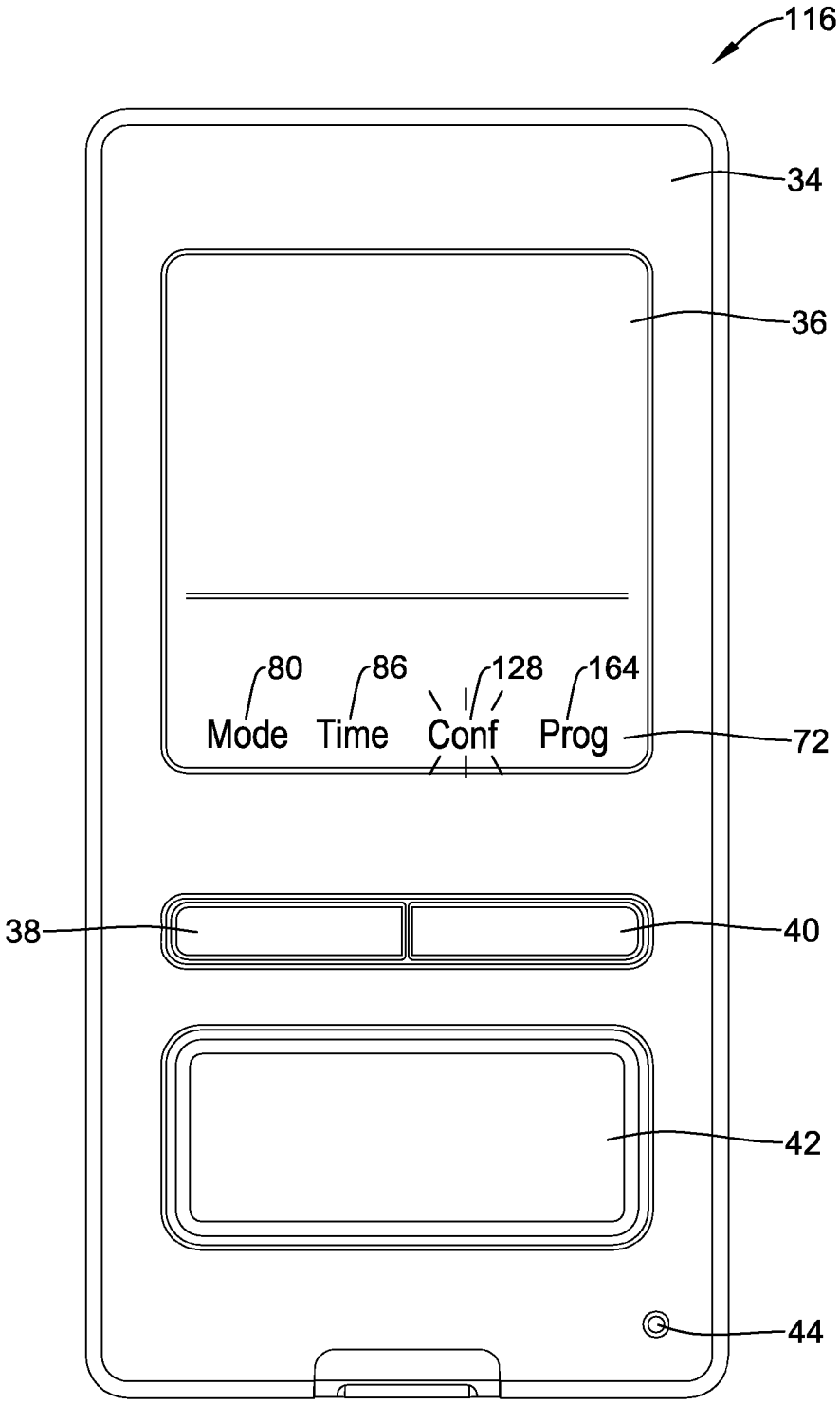

FIG. 6A shows a pictorial view of an illustrative screen 116 of the setup menu, similar to screen 70 of FIG. 4A and screen 82 of FIG. 5A. As illustrated, the "Conf" icon 128 corresponding to the configuration menu may be selected on screen 116. As discussed previously, a desired icon 80, 86, 128, or 164 may be selected by pressing button 38 and/or button 40 to scroll through the list of icons 72. A user may press button 42 to accept the setting and display the corresponding sub-menu. In the illustrative case, when icon 128 is selected and accepted, a configuration menu may be displayed on display 36. Illustrative configuration sub-menu screens 118, 130, 134, 140, and 146 are shown in FIGS. 6B-6F, and each includes the "Conf" icon 128 to show the user where in the menu structure the user is currently operating.

Example configuration options may include backlight options, automatic daylight savings time changeover, longitude coordinates, latitude coordinates, a correction factor for the longitude and latitude, as well as any other configuration options, as desired. In the illustrative embodiment, when the user presses button 42 from screen 116 of FIG. 6A, the display 36 may display screen 118 of FIG. 6B for adjusting the backlight. If button 42 is pressed again, then screen 130 of FIG. 6C may be displayed for adjusting the automatic daylight savings time changeover. If button 42 is pressed again, screen 134 shown in FIG. 6D may be displayed on display 36 for adjusting and/or setting the longitude. If button 42 is pressed again, screen 140, shown in FIG. 6E, may be displayed on display 36 for adjusting and/or setting the latitude. If button 42 is pressed again, screen 146, shown in FIG. 6F, may be displayed on display 36 for setting the correction factor. If button 42 is pressed again, screen 116 of FIG. 6A may be displayed again.

Figure 6B:
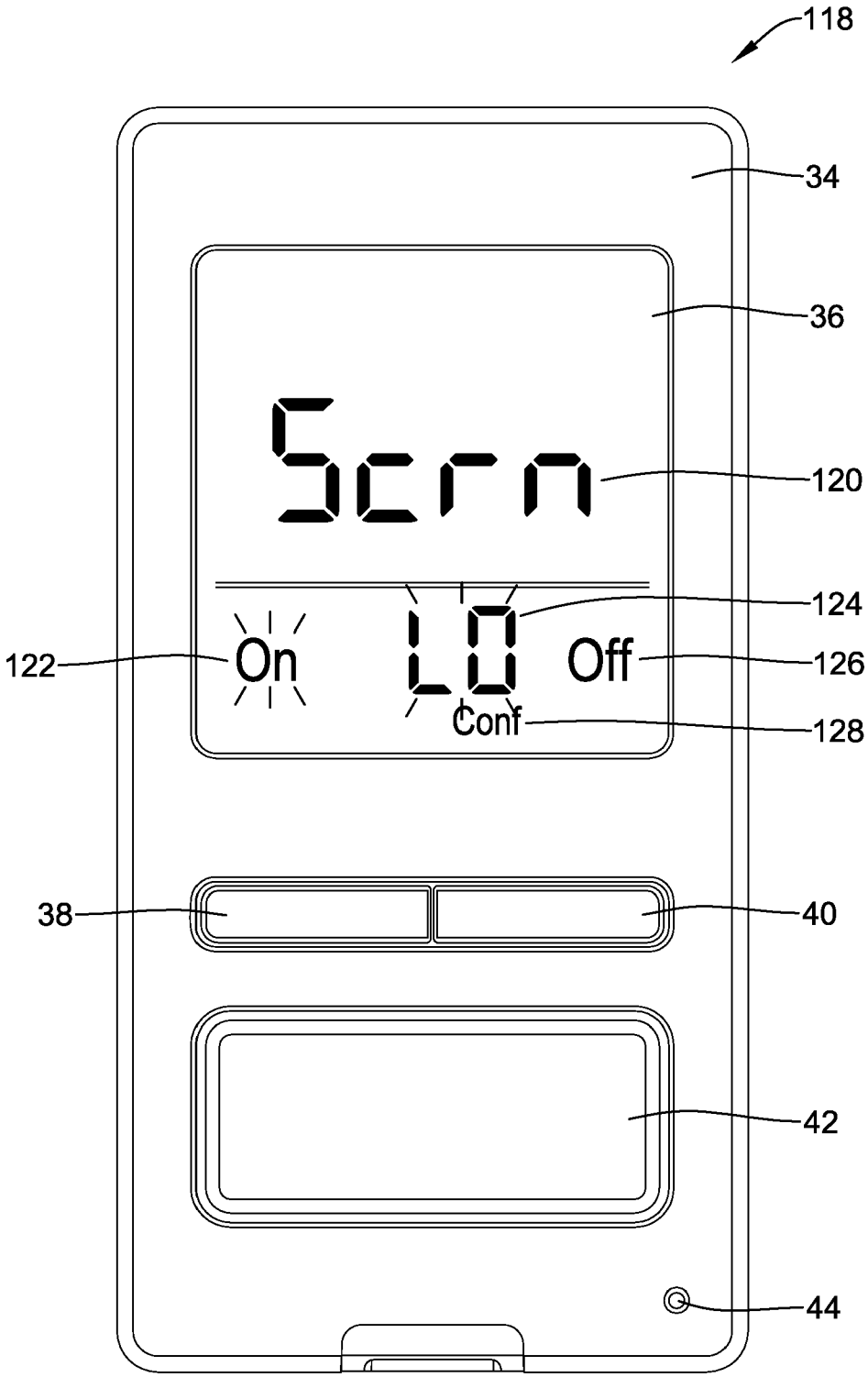

More specifically, FIG. 6B shows a pictorial view of an illustrative screen 118 for setting and/or adjusting the backlight operation of the display 36. In some embodiments, electric timer 30 may include a backlight to illuminate at least a portion of display 36. In some cases, the backlight may be configured to illuminate display 36 when the user presses one of buttons 38, 40, or 42. In one example, the backlight may be configured to illuminate the display 36 for a period of time, such as, for example, one second, two seconds, three seconds, four seconds, five seconds, eight seconds, ten seconds, or any other suitable period of time, as desired. In this case, the period of time may be restarted each time the user touches one of buttons 38, 40, and 42. Additionally, the illustrative electric timer 30 may include one or more backlight operation settings, such as, for example, the brightness, the length of time to illuminate the display 36 after a touch, and/or any other suitable backlight setting, as desired. Example brightness settings may include a high intensity setting, a low intensity setting, and an off setting. Furthermore, it is contemplated that a number of other intensity settings may be used, as desired. In some cases, the backlight may be a white backlight, a blue backlight, an orange backlight, a gray backlight, a red backlight, a yellow backlight, or any other color backlight, as desired.

As illustrated, display 36 may include "Scrn" icon 120 indicating that the electric timer 30 is ready to have the backlight setting(s) set or adjusted. Screen 118 may include an "On" icon 122 indicating that the backlight is on, an "Off" icon 126 indicating that the backlight is off, and an intensity icon 124 indicating the intensity setting of the backlight. As illustrated, the intensity setting may be set to low, as indicated by the "LO" icon 124 displayed. If a high intensity is set, icon 124 may show "HI". In some cases, the current setting may be indicated by flashing, being highlighted, or otherwise indicated. As illustrated, the backlight setting is set to "on" with low intensity.

The user may adjust the backlight operation of the display 36 by pressing button 38 and/or button 40. In some cases, pressing buttons 38 and/or 40 may cycle through the number of backlight settings. For example, pressing button 40 may change the setting to on with high intensity, then, if pressed again, the setting may change to off, and so forth. Pressing button 38 may cycle through the settings in reverse order. However, it is contemplated that the settings may be cycled through in any order or by any button, as desired. To accept the setting, the user may simply press button 42.

Figure 6C:
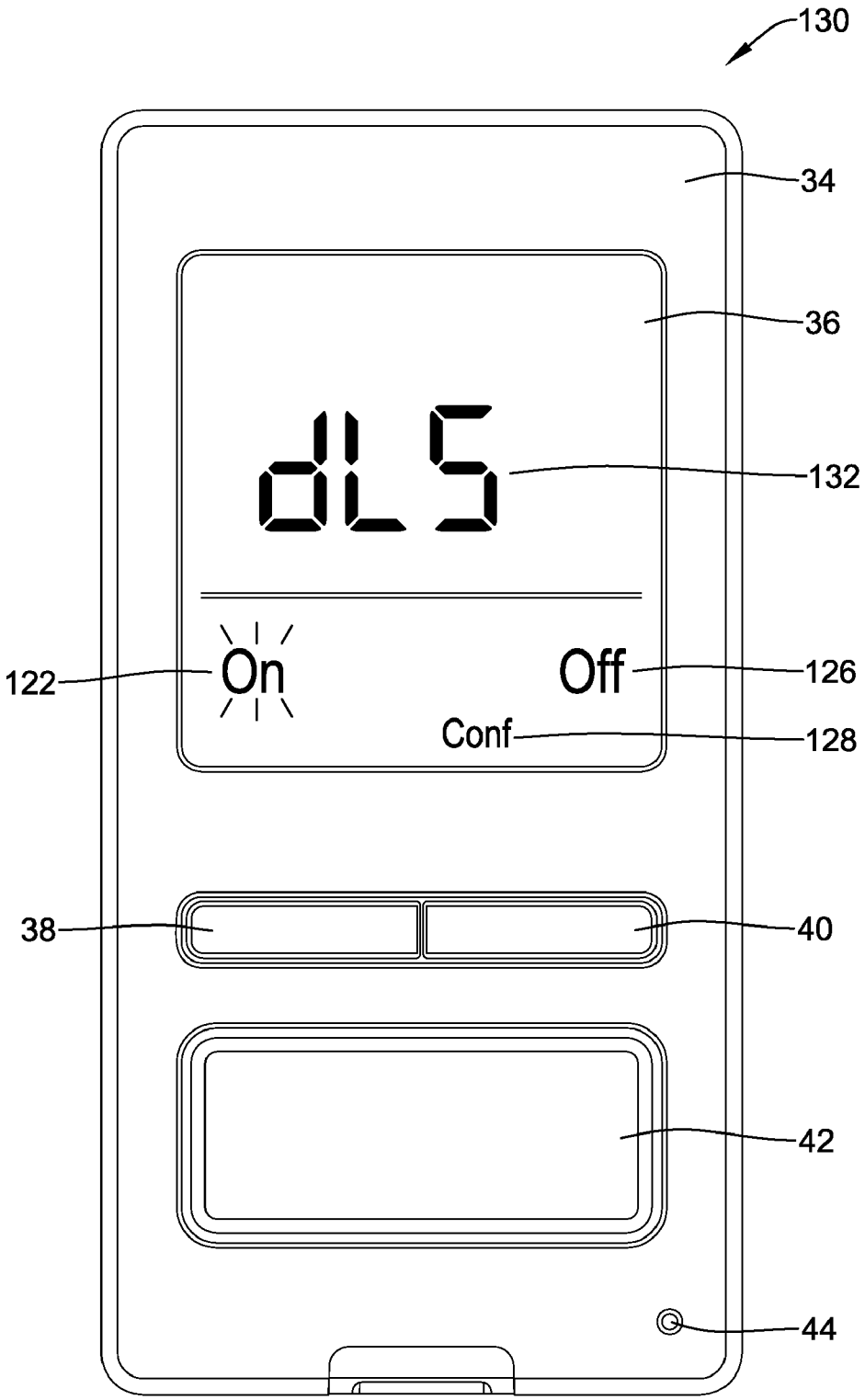

Once accepted, and in the illustrative embodiment, the electric timer 30 may display the illustrative screen 130 shown in FIG. 6C for setting and/or adjusting the automatic daylight savings time changeover (DLS) setting of the electric timer 30. In some embodiments, the DLS setting may automatically change the time of the electric timer 30 according to daylight savings time. For example, on the appropriate date in the spring, the DLS setting may cause the controller 12 to adjust the time (i.e. move one hour ahead) for daylight savings time for the summer and, on the appropriate date in the fall, the DLS setting may cause the controller 12 to adjust the time (i.e. move one hour back) for normal time for the winter. In one example, the DLS setting may cause the controller 12 to change the time to daylight savings time at 2:00 A.M. on the second Sunday in March, and change the time back to normal time at 2:00 A.M. on the first Sunday of November.

As illustrated, screen 130 may include a "dLS" icon 132 on display 36 indicating that the electric timer 30 is ready to program the DLS setting of the electric timer. Screen 130 may also include an "On" icon 122 and an "Off" icon 126 to indicate if the DLS setting is "on" (e.g. active) or "off" (e.g. inactive). As illustrated, the "On" icon 122 may be highlighted, flash, or otherwise indicated when selected. A user may toggle between the "On" icon 122 and the "Off" icon 126 by pressing button 38 and/or button 40. To accept the setting, the user may simply press button 42. In some cases, the "dLS"

icon 132 may be replaced with a "dST" icon, if desired. Furthermore, it is contemplated that any of the icons disclosed herein may be replaced with other suitable icons, as desired.

Figure 6D:
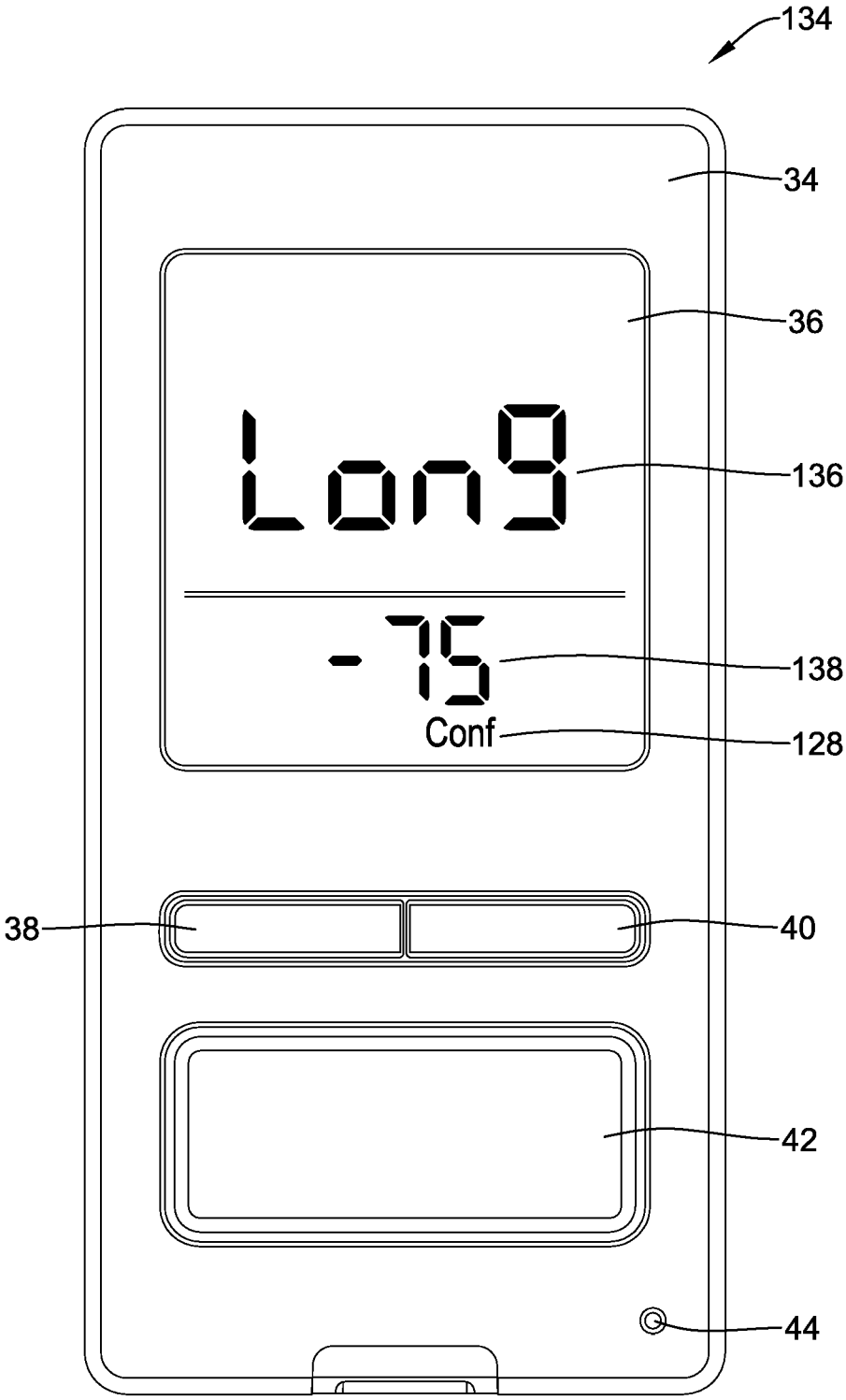
Figure 6E:
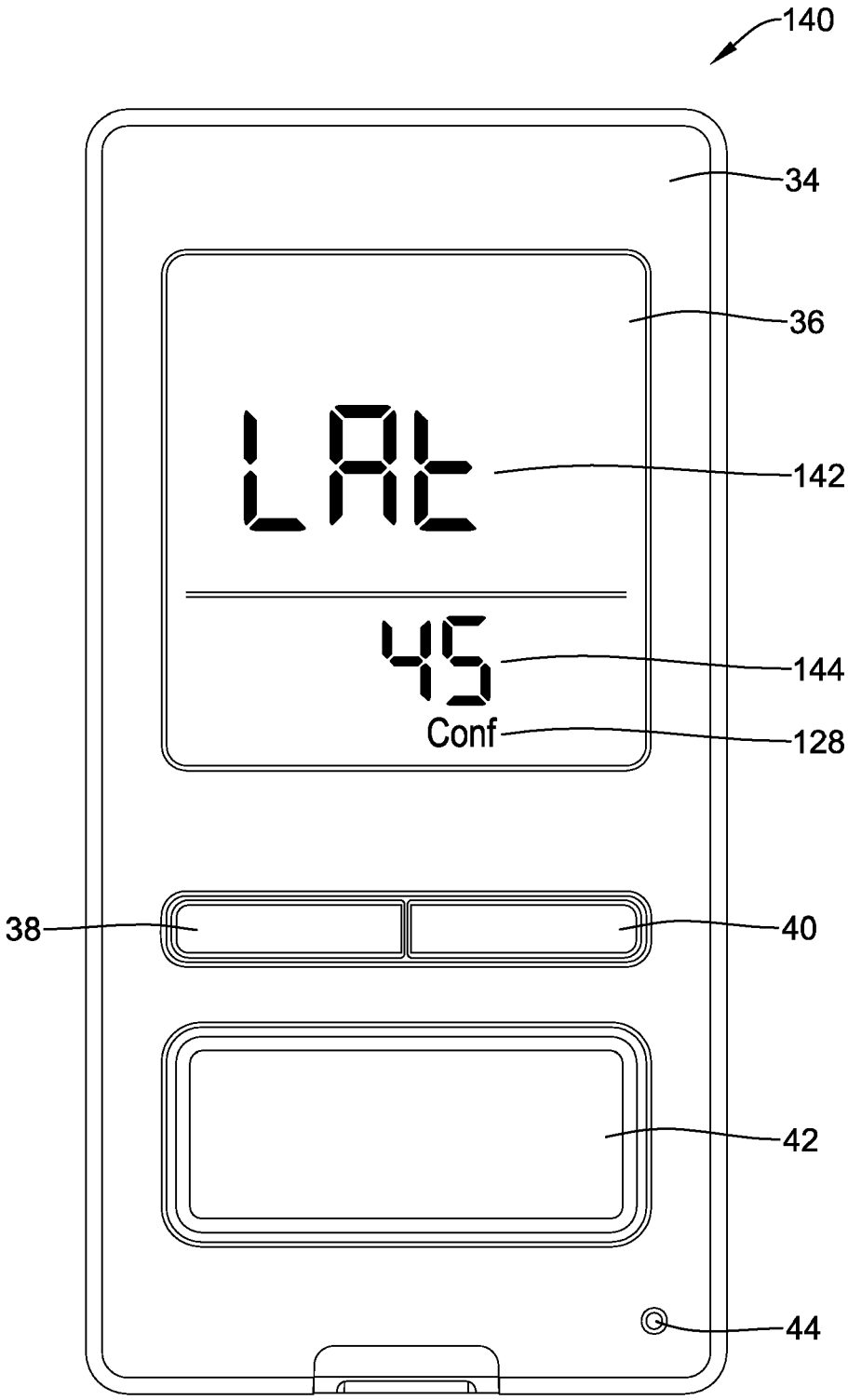

FIGS. 6D-6E show pictorial views of illustrative screens 134 and 140 for setting and/or adjusting the longitudinal and latitudinal coordinates of the electric timer 30. In some embodiments, the longitudinal and latitudinal coordinates may be used to switch the electric timer 30 between the "On" state and the "Off" state, and thus switch power on and off to the load, according to the geographic location of the electric timer. In some cases, the electric timer 30 may switch the load on and off according to the sunset and sunrise times on the current date and time and at the geographic location of the electric timer. For example, if the load is a light, the electric timer 30 may switch the light on at sunset and may switch the lights off at sunrise, where the sunset and sunrise times may be based on the current date, time and geographic location of the electric timer. The controller 12 of the electric timer 30 may be configured to determine the appropriate sunset and sunrise times for the geographic location specified by the longitude and latitude coordinates.

FIG. 6D shows a pictorial view of screen 134 for setting and/or adjusting the longitudinal coordinate of the electric timer 30. As illustrated, screen 134 may include a "Long" icon 136 indicating that the longitudinal coordinate is to be set by the user. Icon 138 may display the current setting of the longitudinal coordinate and may be adjusted by user. In some cases, a negative longitude may indicate that it is West longitude and a positive longitude may indicate that it is East longitude. As illustrated, the longitude is set at "–75" indicated that the longitude is 75 degrees West longitude. The user may adjust the longitudinal coordinate displayed in icon 138 by pressing button 38 and/or button 40 to increase and/or decrease the coordinate. When a desired longitudinal coordinate is displayed on display 36, the user may press button 42 to accept that longitudinal coordinate.

FIG. 6E shows a pictorial view of screen 140 for setting and/or adjusting the latitudinal coordinate of the electric timer 30. As illustrated, screen 140 may include a "LAt" icon 142 indicating that the latitudinal coordinate is to be set by the user. Icon 144 may display the current setting of the latitudinal coordinate and may be adjusted by the user. In some cases, a negative latitude may indicate that it is South latitude and a positive longitude may indicate that it is North latitude. As illustrated, the latitude is set at "45" indicated that the latitude is 45 degrees North latitude. The user may adjust the latitudinal coordinate displayed in icon 138 by pressing button 38 and/or button 40 to increase and/or decrease the coordinate. When a desired latitudinal coordinate is displayed on display 36, the user may press button 42 to accept that latitudinal coordinate.

Figure 6F:
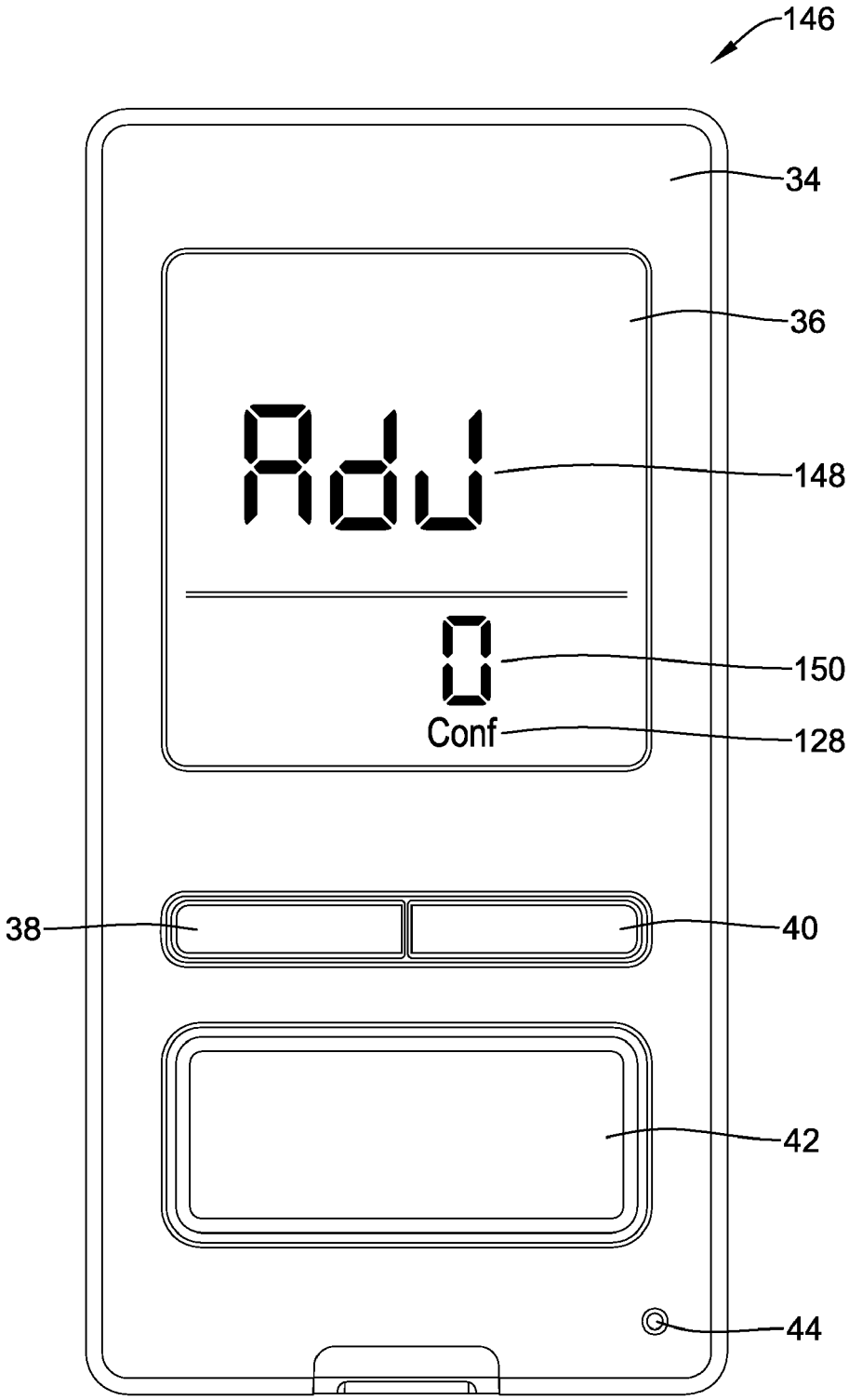

FIG. 6F shows a pictorial view of an illustrative screen 146 for setting and/or adjusting a correction factor. In some embodiments, the electric timer 30 may include the correction factor to help achieve a more accurate and/or an offset for the sunset and/or sunrise times. For example, if the user would like the load to be turned on 0.5 hours before sunset, a suitable correction factor may be provided. As illustrated, screen 146 may include an "Adj" icon 148 displayed on display 36 indicating that the correction factor may be set and/or adjusted by a user. Screen 146 may include a correction factor setting icon 150 showing the current setting of the correction factor. As indicated, the setting is set to "0". In some cases, the correction factor may be set as zero, minus one hour, plus one hour, or any other suitable value, as desired. In the illustrative embodiment, the user may adjust the correction factor by pressing button 38 and/or button 40. When a desired correction factor is displayed in icon 150, the user may press button 42 to accept the setting.

Figure 7A:
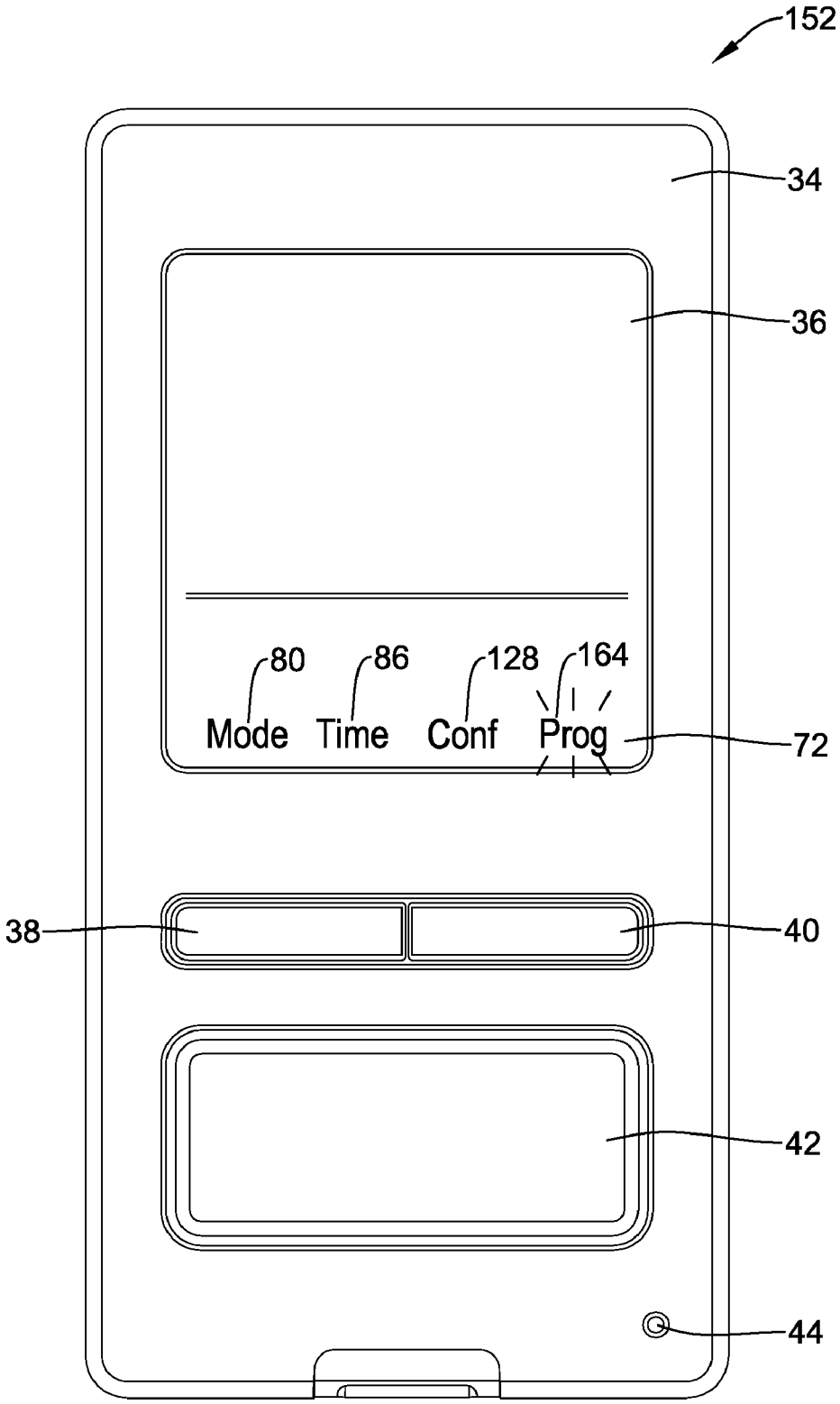

FIG. 7A shows a pictorial view of an illustrative screen 152 of the setup menu, similar to screen 70 of FIG. 4A, screen 82 of FIG. 5A, and screen 116 of FIG. 6A. As illustrated, the "Prog" icon 164 corresponding to the program menu may be selected on screen 152. As discussed previously, a desired icon 80, 86, 128, or 164 may be selected by pressing button 38 and/or button 40 to scroll through the list of icons 72. A user may press button 42 to accept the setting and display the corresponding sub-menu. In the illustrative embodiment, when icon 164 is selected and accepted, a program menu may be displayed on display 36. Example program sub-menus may include screens 154, 166, 168, and 170 of FIGS. 7B-7E, respectively. In each of the sub-menu screens 154, 166, 168, and 170, "Prog" icon 164 may be displayed indicating that the electric timer 30 is in the "Prog" menu.

In the illustrative embodiment of FIG. 7A, the "Prog" icon 164 is selected. When the user presses button 42 from screen 152, the display 36 may display screen 154 of FIG. 7B for selecting a program number. If button 42 is pressed again, then screen 166 of FIG. 7C may be displayed for selecting the program days. If button 42 is pressed again, and no days are selected, screen 154 may be displayed again. If days are selected, then screen 168 shown in FIG. 7D may be displayed on display 36 for setting the program start time. If button 42 is pressed again, screen 170, shown in FIG. 7E, may be displayed on display 36 for further setting of the program start time. If button 42 is pressed again, screen 152, shown in FIG. 7A, or screen 154, shown in FIG. 7B, may be displayed again.

In some embodiments, the program menu may allow a user to program a number of schedules that may be used to switch the electric timer 30 between the "on" state and the "off" state. In some cases, the program menu may allow a user to select a program number, set the days of the program, and set the start time and/or stop time of the program, as well as any other program settings, as desired. In some cases, the program may be configured to switch the "on" state and/or the "off" state of the electric switch 30 according to solar time (i.e. sunset, sunrise, etc.).

Figure 7B:
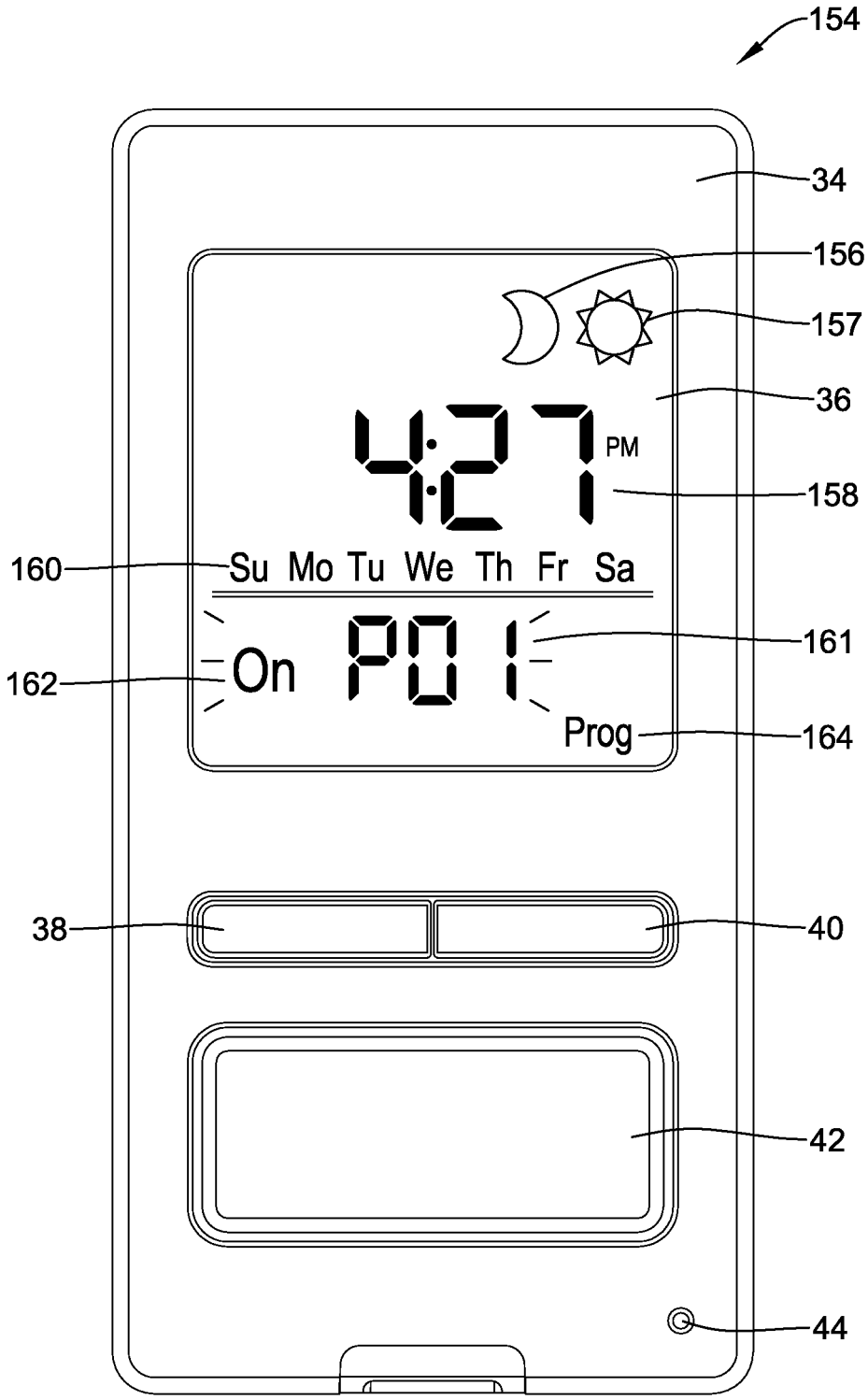

As indicated above, FIG. 7B shows a pictorial view of an illustrative screen 154 for selecting a program number. In some cases, the program may include a plurality of programs. For example, the program may include a number of "on" programs and a number of "off" programs. The "on" programs may set when the electric timer 30 turns the load on, and the "off" programs may set when the electric timer 30 turns the load off. In some cases, there may be one, two, three, four, five, six, seven, ten, or any number of "on" programs and "off" programs, as desired.

As illustrated, screen 154 may include the time 158. Screen 154 may also include a number of icons 160 corresponding to the days of the week. Screen 154 may also include a program icon 161 indicating the program to be set. As illustrated, the program icon shows "P01", which may correspond to program 1. In addition, "on" icon 162 may be provided to show that the program is for turning the load "on". Although not expressly shown, if a program is for turning a load "off", an "Off" icon, similar to "on" icon 162, may be displayed. In some cases, icon 156 may be displayed to indicate that the displayed program is to be activated at sunset, rather than a specific set time. In some cases, an icon similar to icon 157 may be displayed to indicate that the program is to be activated at sunrise.

In operation, a user may press button 38 and/or button 40 to toggle through the list of available programs. When a desired program is displayed at icon 161, the user may press button 42 to select the program. In some embodiments, the one or more programs may be password protected. In this case, the electric switch 30 may include an additional screen (not shown) for prompting a user to enter a password. Once the password is entered, the user may be able to modify the one or more programs.

Figure 7C:
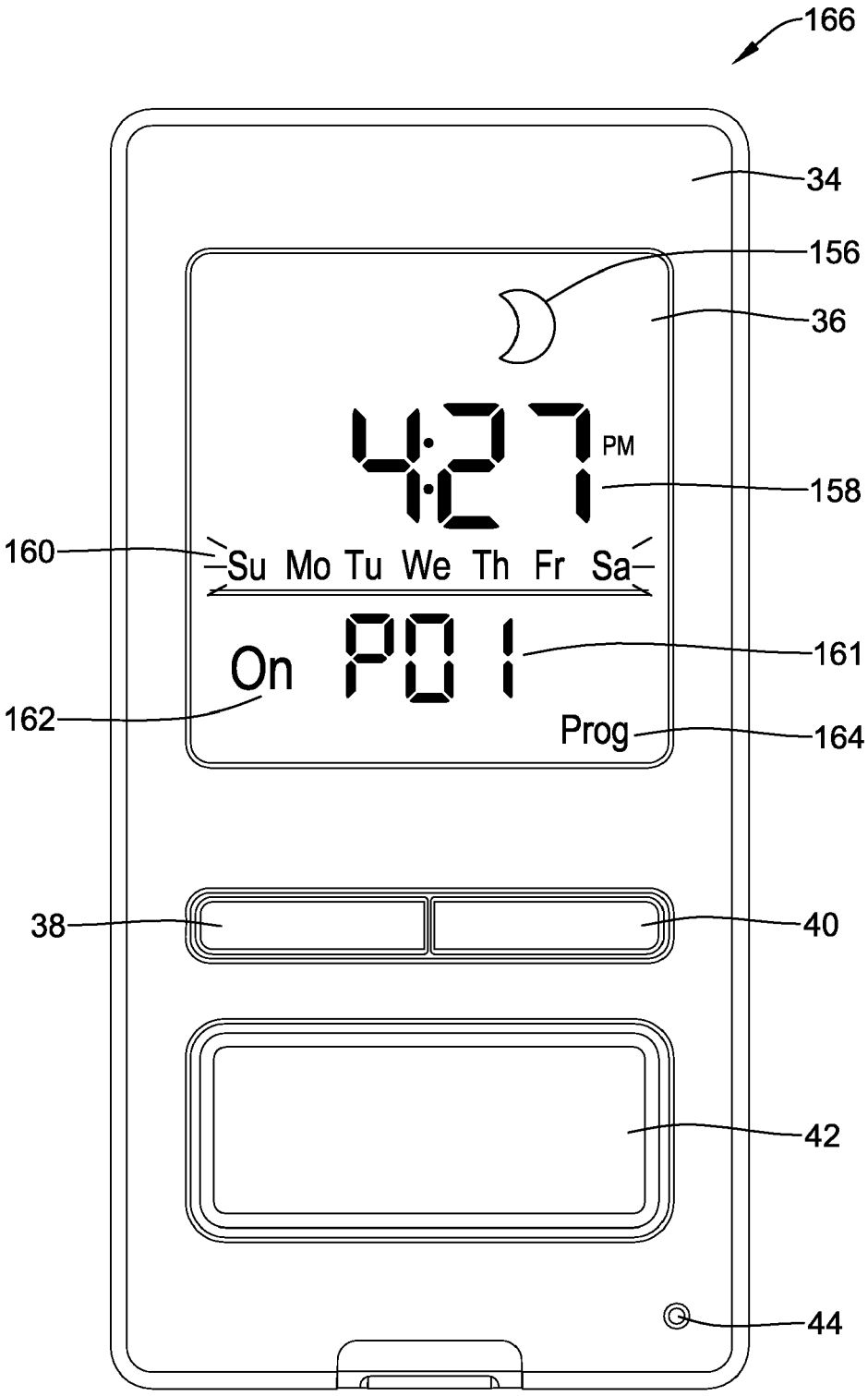

FIG. 7C shows a pictorial view of an illustrative screen 166 for selecting days for the selected program. As illustrated, screen 166 may display a list of icons 160 corresponding to the days of the week. In some cases, the list of icons 160 may be highlighted, flash, or otherwise indicated. In some cases, a user may select desired days using button 38 and/or button 40 that are to be used for the selected program. For example, a user may select all the days of the week, all weekdays, the weekend (i.e. Saturday and Sunday), individual days (i.e. Sunday, Monday, Tuesday, Wednesday, Thursday, Friday, or Saturday), or any combination of individual days of the week, as desired. In some cases, the combination of individual days of the week may include consecutive days or non-consecutive days, as desired.

In some embodiments, a user may scroll through a list for selecting the days. In some cases, the list may include a first entry for all the days of the week, a second entry for all of the weekdays, a third entry for the weekend days, a fourth entry for Sunday, a fifth entry for Monday, a sixth entry for Tuesday, a seventh entry Wednesday, an eighth entry for Thursday, a ninth entry for Friday, and a tenth entry for Saturday. When so provided, the user may scroll through the list using button 38 and/or button 40 to select the desired day(s).

In other embodiments, a user may be able to move through the list of days 160 and individually select days. For example, one of button 38 or button 40 may move through the list and the other one of button 38 or button 40 may select the day. In either case, when the desired day(s) are selected, a user may press button 42 to accept the setting.

Figure 7D:
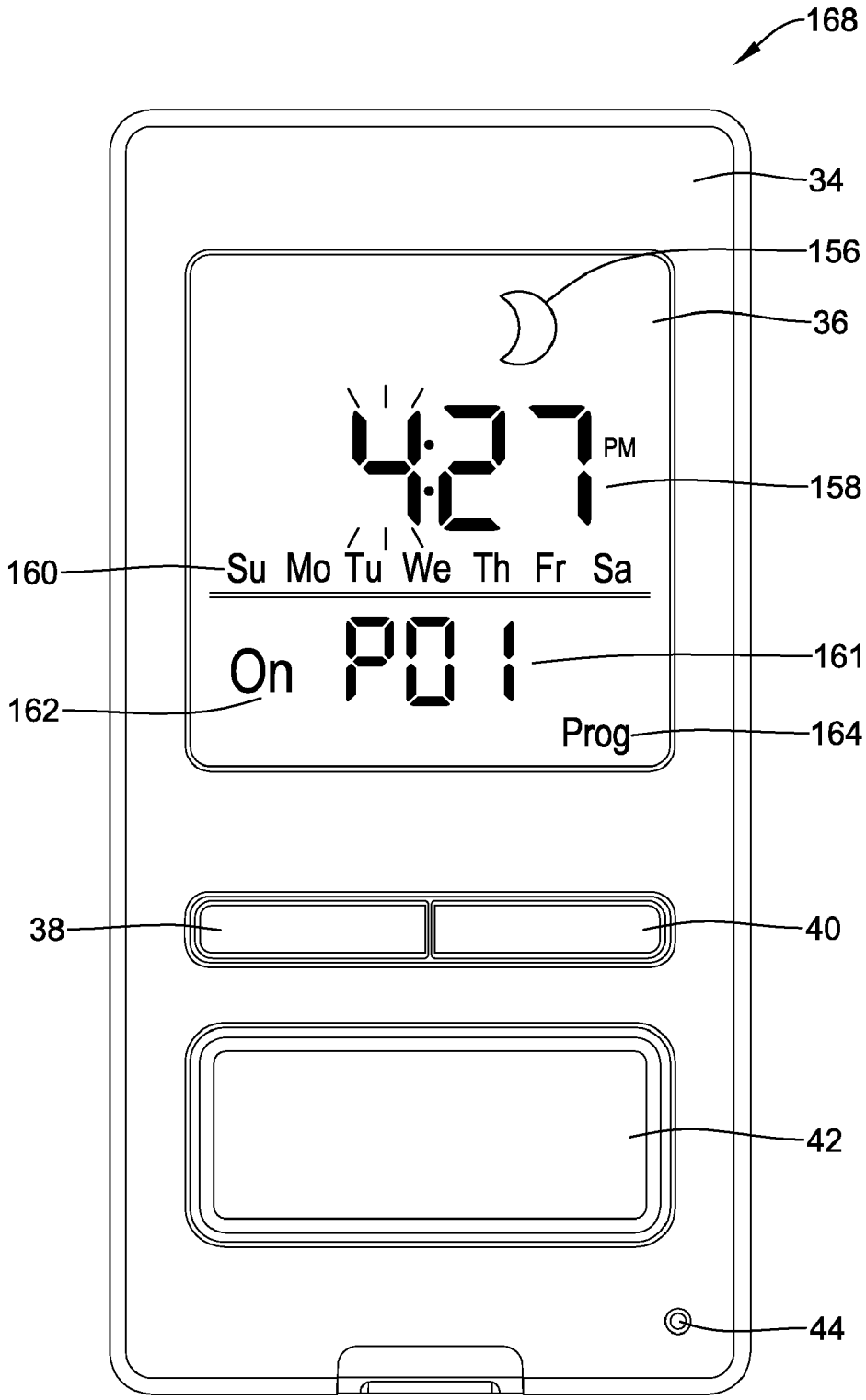

FIG. 7D shows a pictorial view of an illustrative screen 168 for setting the program start time. The program start time may determine when the controller 12 turns the load "on" when the program includes an "on" icon 162, or when the controller 12 turns the load "off" when the program includes an "off" icon 162. As illustrated in FIG. 7D, the hour field of the time display 158 may be highlighted, blink, or otherwise indicated. A user may press button 38 and/or button 40 to increase and/or decrease the hour field of the time display 158 until the desired hour is displayed. In some cases, A.M. and P.M. may be associated with the hour field of the time display 158.

In some embodiments, the electric timer 30 may be programmed to turn on according to sunset and/or sunrise time. In this case, a user may scroll through the hour field until a "sunrise" and/or "sunset" parameter is displayed (not explicitly show). When the desired setting is displayed in the hour field of time display 158, the user may press button 42 to accept the settings.

Figure 7E:
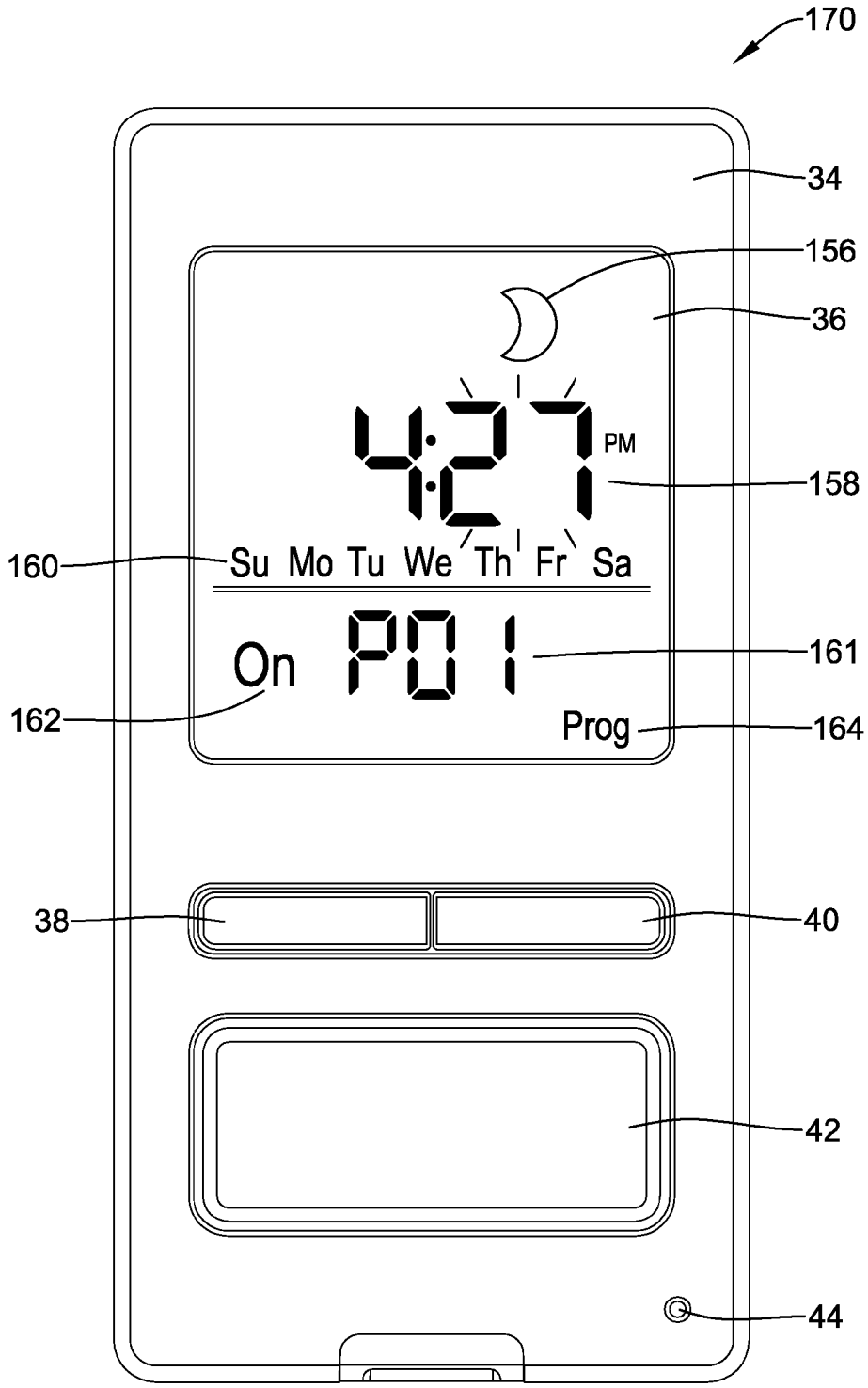

FIG. 7E shows a pictorial view of an illustrative screen 170 for further setting the program start time. As illustrated in screen 170, the minute field of the time display 158 may be highlighted, flashing, or otherwise indicated. A user may adjust the minute field to display a desired minute field using button 38 and/or button 40. In some embodiments, if the hour field of FIG. 7D was selected to be sunset or sunrise, the minute field of FIG. 7E may allow a user to select an offset value. In some cases, the offset may be an amount of time before or after sunset or sunrise for the program to start. In some instances, the offset may be entered according to time intervals, such as, for example, five minutes, ten minutes, fifteen minutes, twenty minutes, thirty minutes, as well as any other suitable timer interval, as desired. Also, in some cases, the offset may include an offset limit. For example, the offset limit may be thirty minutes, sixty minutes, seventy minutes, ninety minutes, or any other suitable offset limit, as desired. When the desired offset value or minute field value is shown on the display 36, the user may press button 42 to accept the setting.

Having thus described the preferred embodiments of the present invention, those of skill in the art will readily appreciate that yet other embodiments may be made and used within the scope of the claims hereto attached. Numerous advantages of the invention covered by this document have been set forth in the foregoing description. It will be understood, however, that this disclosure is, in many respect, only illustrative. Changes may be made in details, particularly in matters of shape, size, and arrangement of parts without exceeding the scope of the invention. The invention's scope is, of course, defined in the language in which the appended claims are expressed.

The invention claimed is:

1. A wall mountable electric timer for switching power to a load between an "on" state and an "off" state in accordance with a programmable schedule, the wall mountable electric timer comprising:

a housing having a front, a back and side walls extending between the front and the back, the housing configured to be mountable to a wall with the back situated toward the wall and the front facing away from the wall;

at least one memory for storing a programmable schedule and one or more controller settings;

a controller coupled to the at least one memory for controlling the switching of power to a load between an "on" state and an "off" state in accordance with the programmable schedule;

a user interface situated on the front of the housing and coupled to the controller, the user interface including a display, a first button, and a second button;

the controller is programmed such that a user can program the programmable schedule and the one or more controller settings by interacting with only the first button and the second button;

wherein the controller has an operating mode and a setup mode;

wherein in the operating mode, depressing the first button causes the controller to switch power to the load between the "on" state and the "off" state; and wherein in the operating mode, depressing the first button for an extended period of time causes the controller to enter the setup mode.

2. The wall mountable electric timer of claim 1, wherein in the operating mode, the current day of the week and the active programmable schedule are displayed on the display.

3. The wall mountable electric timer of claim 1, wherein the extended period of time is at least 1 second.

4. The wall mountable electric timer of claim 1, wherein, when the setup mode is initially entered, depressing the second button causes the controller to designate a next setup menu on the display from two or more setup menu choices.

5. The wall mountable electric timer of claim 4, wherein depressing the first button causes the controller to select the designated setup menu.

6. The wall mountable electric timer of claim 5, wherein depressing the first button causes the controller to select the designated setup menu and display at least one parameter related to the designated setup menu on the display.

7. The wall mountable electric timer of claim 6, wherein the user interface further includes a third button, wherein the controller is programmed such that a user can program the programmable schedule and the one or more controller settings by interacting with only the first button, the second button and the third button, and wherein once the designated setup menu is selected, depressing the second button or the third button causes the controller to change a value of the at least one parameter.

8. The wall mountable electric timer of claim 7, wherein depressing the first button causes the controller to accept the changed parameter value and advance to a next parameter.

9. The wall mountable electric timer of claim 8, wherein the changed parameter blinks one or more times to indicate that the changed parameter value has been accepted.

10. The wall mountable electric timer of claim 1, wherein the controller includes a microcontroller, and the at least one memory is part of the microcontroller.

11. The wall mountable electric timer of claim 1, wherein the controller includes a microcontroller, and the at least one memory is external to the microcontroller.

12. The wall mountable electric timer of claim 1, wherein the user interface further includes a third button, wherein the controller is programmed such that a user can program the programmable schedule and the one or more controller settings by interacting with only the first button, the second button and the third button, and wherein in the operating mode, depressing the second button causes the controller to display a sunrise time parameter on the display, and depressing the third button causes the controller to display a sunset time parameter on the display.

13. A wall mountable electric timer for switching power to a load between an "on" state and an "off" state in accordance with a schedule, the wall mountable electric timer comprising:

a housing having a front, a back and side walls extending between the front and the back, the housing configured to be mountable to a wall with the back situated toward the wall and the front facing away from the wall;

a controller for controlling the switching of power to a load between an "on" state and an "off" state in accordance with the schedule; and wherein the controller is programmed to randomly generate a random schedule of turn "on" times and turn "off" times during a predetermined time period, each of the randomly generated turn "on" times and turn "off" times not being based upon a corresponding preprogrammed turn "on" times and turn "off" times of the schedule; and wherein the controller is configured to switch power to the load in accordance with the turn "on" and turn "off" times of the random schedule.

* * * * *